US011268363B2

(12) United States Patent
Fripp et al.

(10) Patent No.: US 11,268,363 B2
(45) Date of Patent: Mar. 8, 2022

(54) MULTI-ZONE ACTUATION SYSTEM USING WELLBORE DARTS

(71) Applicant: Halliburton Energy Services, Inc., Houston, TX (US)

(72) Inventors: Michael Linley Fripp, Carrollton, TX (US); Zachary William Walton, Carrollton, TX (US); Matthew James Merron, Dallas, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/761,186

(22) PCT Filed: Dec. 21, 2017

(86) PCT No.: PCT/US2017/067892
§ 371 (c)(1),
(2) Date: May 1, 2020

(87) PCT Pub. No.: WO2019/125465
PCT Pub. Date: Jun. 27, 2019

(65) Prior Publication Data

US 2020/0355054 A1 Nov. 12, 2020

(51) Int. Cl.
*E21B 43/25* (2006.01)
*E21B 47/06* (2012.01)
(Continued)

(52) U.S. Cl.
CPC ..... *E21B 43/25* (2013.01); *E21B 34/14* (2013.01); *E21B 43/16* (2013.01); *E21B 47/06* (2013.01); *E21B 47/12* (2013.01); *E21B 2200/06* (2020.05)

(58) Field of Classification Search
CPC ..... E21B 2200/06; E21B 43/25; E21B 34/14; E21B 43/16; E21B 47/06; E21B 47/12; E21B 47/00
See application file for complete search history.

(56) References Cited

U.S. PATENT DOCUMENTS 9,010,442 B2 4/2015 Streich et al.
9,546,538 B2 1/2017 Hulsewe et al.
(Continued)

FOREIGN PATENT DOCUMENTS

CN 1051607 A 5/1991
CN 105952418 A 9/2016
(Continued)

OTHER PUBLICATIONS

International Search Report and Written Opinion issued in related PCT Application No. PCT/US2017/067892 dated Sep. 13, 2018, 17 pages.
(Continued)

*Primary Examiner* — Brad Harcourt
(74) *Attorney, Agent, or Firm* — Scott Richardson; Baker Botts L.L.P.

(57) ABSTRACT

Sliding sleeve assemblies may include one or more sliding sleeve tools to stimulate one or more zones in a wellbore. The one or more sliding sleeve tools may be actuated based on an actuation sensor. A property sensor may be disposed adjacent to a sliding sleeve tool to collect data indicative of a wellbore property associated with one or more different zones of a fracture or the actuation sleeve. The property sensor may transmit data to the surface or to other property sensors associated with downhole tools. Configuring or disposing one or more property sensors to a downhole tool may provide real-time feedback regarding the rate of production for a particular zone or area downhole.

18 Claims, 9 Drawing Sheets

(51) Int. Cl.

| | |
|---|---|
| ***E21B 34/14*** | (2006.01) |
| ***E21B 43/16*** | (2006.01) |
| ***E21B 47/12*** | (2012.01) |

(56) References Cited

U.S. PATENT DOCUMENTS

| | | | | |
|---|---|---|---|---|
| 10,392,910 | B2 | 8/2019 | Walton et al. | |
| 2003/0043055 | A1* | 3/2003 | Schultz | E21B 47/26 340/856.3 |
| 2004/0256113 | A1 | 12/2004 | LoGiudice et al. | |
| 2010/0126730 | A1 | 5/2010 | Desai | |
| 2014/0083689 | A1 | 3/2014 | Streich et al. | |
| 2014/0262237 | A1 | 9/2014 | Walton et al. | |
| 2015/0075780 | A1* | 3/2015 | Richards | E21B 34/06 166/250.1 |
| 2015/0285034 | A1 | 10/2015 | Frisby | |
| 2015/0285065 | A1 | 10/2015 | Howell et al. | |
| 2015/0285066 | A1 | 10/2015 | Keller et al. | |
| 2015/0292321 | A1 | 10/2015 | Keller et al. | |
| 2016/0032683 | A1 | 2/2016 | Wood et al. | |
| 2016/0108722 | A1* | 4/2016 | Whitsitt | E21B 34/14 166/254.1 |
| 2016/0145972 | A1 | 5/2016 | Allen et al. | |
| 2016/0160568 | A1* | 6/2016 | Randall | E21B 7/18 175/26 |
| 2016/0258260 | A1* | 9/2016 | Walton | E21B 33/13 |
| 2019/0249520 | A1* | 8/2019 | Merron | E21B 43/25 |

FOREIGN PATENT DOCUMENTS

| | | | |
|---|---|---|---|
| CN | 206319872 | U | 7/2017 |
| WO | 2018/013131 | A1 | 1/2018 |

OTHER PUBLICATIONS

Written Opinion and Search Report issued in related Singapore Patent Application No. 11202001893Y dated Sep. 14, 2021, 8 pages.

Office Action issued in related Chinese Patent Application No. 201780095751.8 dated Jul. 6, 2021, 15 pages (with translation.).

* cited by examiner

MULTI-ZONE ACTUATION SYSTEM USING WELLBORE DARTS

CROSS-REFERENCE TO RELATED APPLICATION

The present application is a U.S. National Stage Application of International Application No. PCT/US2017/067892 filed Dec. 21, 2017, which is incorporated herein by reference in its entirety for all purposes.

BACKGROUND

The present disclosure relates generally to wellbore operations and, more particularly, to a multi-zone actuation system that detects wellbore darts in carrying out multiple-interval stimulation of a well bore.

In the oil and gas industry, subterranean formations penetrated by a wellbore are often fractured or otherwise stimulated in order to enhance hydrocarbon production. Fracturing and stimulation operations are typically carried out by strategically isolating various zones of interest (or intervals within a zone of interest) in the wellbore using packers and the like, and then subjecting the isolated zones to a variety of treatment fluids at increased pressures. In a typical fracturing operation for a cased wellbore, the casing cemented within the wellbore is first perforated to allow conduits for hydrocarbons within the surrounding subterranean formation to flow into the wellbore. Prior to producing the hydrocarbons, however, treatment fluids are pumped into the wellbore and the surrounding formation via the perforations, which has the effect of opening and enlarging drainage channels in the formation, and thereby enhancing the producing capabilities of the well.

Today, it is possible to stimulate multiple zones during a single stimulation operation by using onsite stimulation fluid pumping equipment. In such applications, several packers are introduced into the wellbore and each packer is strategically located at predetermined intervals configured to isolate adjacent zones of interest. Each zone may include a sliding sleeve that is moved to permit zonal stimulation by diverting flow through one or more tubing ports occluded by the sliding sleeve. Once the packers are appropriately deployed, the sliding sleeves may be selectively shifted open using a ball and baffle system. The ball and baffle system involves sequentially dropping wellbore projectiles from a surface location into the wellbore. The wellbore projectiles, commonly referred to as "frac balls," are of predetermined sizes configured to seal against correspondingly sized baffles or seats disposed within the wellbore at corresponding zones of interest. The smaller frac balls are introduced into the well bore prior to the larger frac balls, where the smallest frac ball is designed to land on the baffle furthest in the well and the largest frac ball is designed to land on the baffle closest to the surface of the well. Accordingly, the frac balls isolate the target sliding sleeves, from the bottom-most sleeve moving uphole. Applying hydraulic pressure from the surface serves to shift the target sliding sleeve to its open position.

Thus, the ball and baffle system acts as an actuation mechanism for shifting the sliding sleeves to their open position downhole. When the fracturing operation is complete, the balls can be either hydraulically returned to the surface or drilled up along with the baffles in order to return the casing string to a full bore inner diameter. As can be appreciated, at least one shortcoming of the ball and baffle system is that there is a limit to the maximum number of zones that may be stimulated owing to the fact that the baffles are of graduated sizes.

Additionally, real-time data, for example, data indicative of a wellbore property associated with one or more different zones of a fracture or the actuation sleeve, may provide valuable information to increase the efficiency of production operations. Configuring or disposing one or more sensors to a downhole tool may provide real-time feedback regarding the rate of production for a particular zone or area downhole. The one or more sensors may transmit data to the surface or to other sensors associated with downhole tools. Current techniques using fiber optics to monitor a fracture may be expensive to install and may not provide precise measurement of flow properties. An implementation of one or more sensors that provides effective and real-time monitoring of wellbore properties would increase efficiency in production of hydrocarbons or stimulation and evaluation techniques of one or more fracture zones.

BRIEF DESCRIPTION OF THE DRAWINGS

The following figures are included to illustrate certain aspects of the present disclosure, and should not be viewed as exclusive embodiments. The subject matter disclosed is capable of considerable modifications alterations combinations, and equivalents in form and function, without departing from the scope of this disclosure.

DETAILED DESCRIPTION

The present disclosure relates generally to well bore operations and, more particularly, to a multi-zone actuation system that detects wellbore darts in carrying out multiple-interval stimulation of a wellbore.

The embodiments described herein disclose sliding sleeve assemblies that are able to detect wellbore darts and actuate a sliding sleeve upon detecting a predetermined number of wellbore darts having dart profiles defined thereon.

Once a predetermined number of wellbore darts has been detected, an actuation sleeve may be actuated to expose a sleeve mating profile defined on a sliding sleeve. After the sleeve mating profile is exposed, a subsequent wellbore dart introduced downhole may be able to locate and mate with its dart profile with the sleeve mating profile. Upon applying fluid pressure uphole from the subsequent wellbore dart, the sliding sleeve may then be moved to an open position, where flow ports become exposed and facilitate fluid communication into a surrounding subterranean environment for wellbore stimulation operations. The presently disclosed embodiments, therefore, provide intervention-less wellbore stimulation methods and systems.

Figure 1:
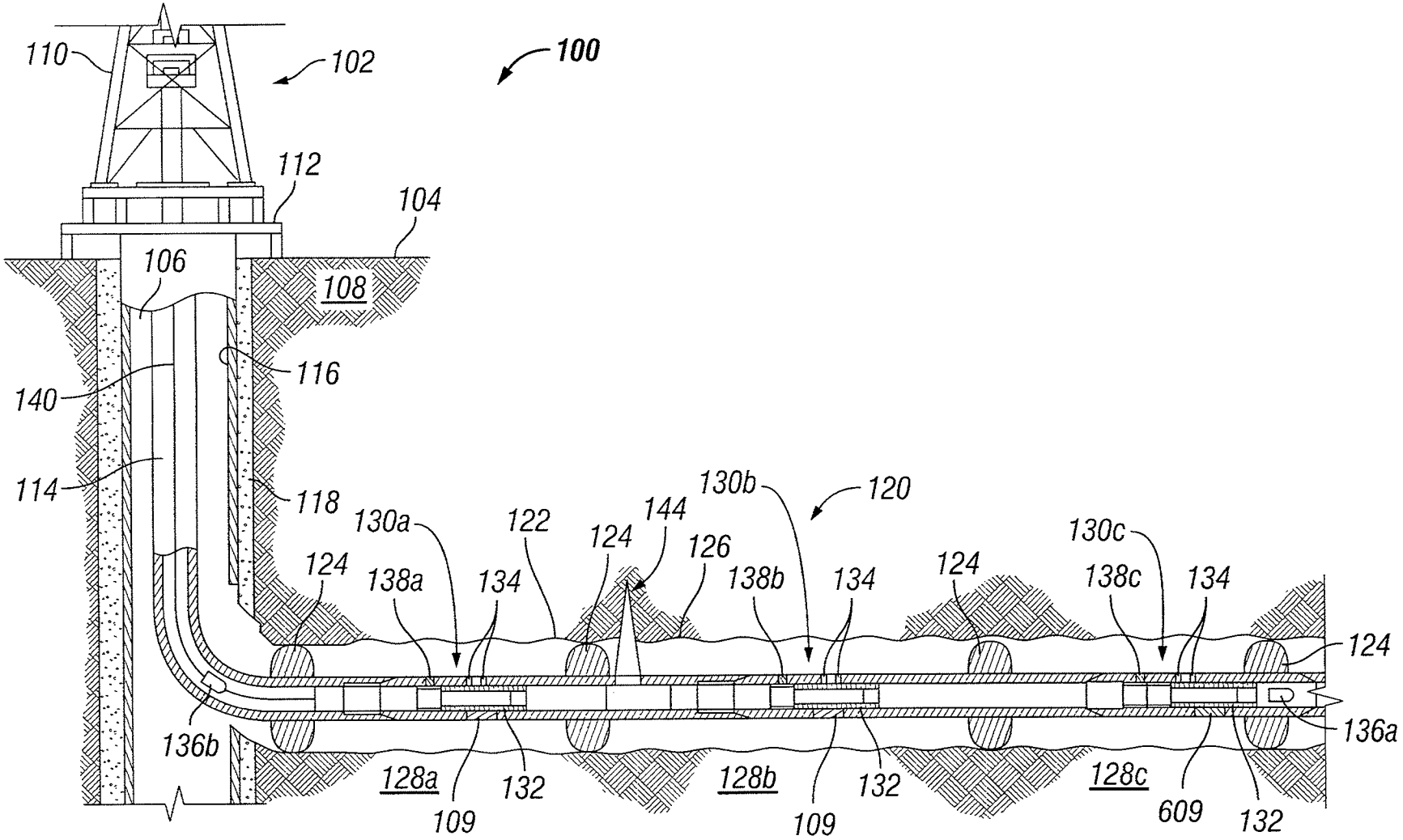
FIG. 1 illustrates an exemplary well system for deploying a downhole tool that utilizes a sliding sleeve and one or more sensors according to one or more embodiments of the present disclosure.

Referring to FIG. 1, illustrated is an exemplary well system 100 which can embody or otherwise employ one or more principles of the present disclosure, according to one or more embodiments. As illustrated, the well system 100 may include a rig 102 arranged at surface 104 and a wellbore 106 extending therefrom and penetrating a subterranean formation 108. Even though FIG. 1 depicts a land-based rig 102, it will be appreciated that the embodiments of the present disclosure are equally well suited for use in other types of rigs, such as offshore platforms, or rigs used in any other geographical locations. In other embodiments, the rig 102 may be replaced with a wellhead installation, without departing from the scope of the disclosure.

The rig 102 may include a derrick 110 and a rig floor 112. The derrick 110 may support or otherwise help manipulate the axial position of a work string 114 extended within the wellbore 106 from the rig floor 112. As used herein, the term "work string" refers to one or more types of connected lengths of tubulars or pipe such as drill pipe, drill string, landing string, production tubing, coiled tubing combinations thereof, or the like. The work string 114 may be utilized in drilling, stimulating, completing, or otherwise servicing the wellbore 106, or various combinations thereof.

As illustrated, the wellbore 106 may extend vertically away from the surface 104 over a vertical wellbore portion. In other embodiments, the wellbore 106 may otherwise deviate at any angle from the surface 104 over a deviated or horizontal well bore portion. In other applications, portions or substantially all of the wellbore 106 may be vertical, deviated, horizontal, curved or any combination thereof. Moreover, use of directional terms such as above, below, upper, lower, upward, downward, uphole, downhole, and the like are used in relation to the illustrative embodiments as they are depicted in the figures, the upward direction being toward the top of the corresponding figure and the downward direction being toward the bottom of the corresponding figure, the uphole direction being toward the heel or surface of the well and the downhole direction being toward the toe or bottom of the well.

In an embodiment, the wellbore 106 may be at least partially cased with a casing string 116 or may otherwise remain at least partially uncased. The casing string 116 may be secured within the wellbore 106 using, for example, cement 118. In other embodiments, the casing string 116 may be only partially cemented within the wellbore 106 or, alternatively, the casing string 116 may be omitted from the well system 100, without departing from the scope of the disclosure.

The work string 114 may be coupled to a completion assembly 120 that extends into a branch or lateral portion 122 of the wellbore 106. As illustrated, the lateral portion 122 may be an uncased or "open hole" section of the wellbore 106. It is noted that although FIG. 1 depicts the completion assembly 120 as being arranged within the lateral portion 122 of the wellbore 106, the principles of the apparatus, systems, and methods disclosed herein may be similarly applicable to or otherwise suitable for use in wholly vertical wellbore configurations.

Consequently, the horizontal or vertical nature of the wellbore 106 should not be construed as limiting the present disclosure to any particular wellbore 106 configuration.

The completion assembly 120 may be deployed within the lateral portion 122 of the wellbore 106 using one or more packers 124 or other wellbore isolation devices known to those skilled in the art. The packers 124 may be configured to seal off an annulus 126 defined between the completion assembly 120 and the inner wall of the wellbore 106. As a result, the subterranean formation 108 may be effectively divided into multiple intervals or "pay zones" 128 (shown as intervals 128*a*, 128*b*, and 128*c*) which may be stimulated, produced or any combination thereof independently via isolated portions of the annulus 126 defined between adjacent pairs of packers 124.

While only three intervals 128*a*, 128*b*, and 128*c* are shown in FIG. 1, those skilled in the art will readily recognize that any number of intervals 128*a*, 128*b*, and 128*c* may be defined or otherwise used in the well system 100, including a single interval, without departing from the scope of the disclosure.

The completion assembly 120 may include one or more sliding sleeve assemblies 130 (shown as sliding sleeve assemblies 130*a*, 130*b*, and 130*c*) arranged in, coupled to, or otherwise forming integral parts of the work string 114. As illustrated, at least one sliding sleeve assembly 130*a-c* may be arranged in each interval 128*a*, 128*b*, and 128*c*, but those skilled in the art will readily appreciate that more than one sliding sleeve assembly 130*a*, 130*b*, and 130*c* may be arranged in each interval 128*a*, 128*a*, and 128*c*, without departing from the scope of the disclosure. It should be noted that, while the sliding sleeve assemblies 130*a*, 130*b*, and 130*c* are shown in FIG. 1 as being employed in an open hole section of the wellbore 106, the principles of the present disclosure are equally applicable to completed or cased sections of the wellbore 106. In such embodiments, a cased wellbore 106 may be perforated at predetermined locations in each interval 128*a*, 128*b*, and 128*c* to facilitate fluid conductivity between the interior of the work string 114 and the surrounding intervals 128*a*, 128*b*, and 128*c* of the formation 108.

Each sliding sleeve assembly 130*a*, 130*b*, and 130*c* may be actuated in order to provide fluid communication between the interior of the work string 114 and the annulus 126 adjacent each corresponding interval 128*a*, 128*b* and 128*c*. As depicted, each sliding sleeve assembly 130*a*, 130*b* and 130*c* may include a sliding sleeve 132 that is axially movable within the work string 114 to expose one or more ports 134 defined through the work string 114. Sliding sleeve 132 may comprise one or more actuators 109. Once exposed, the ports 134 may facilitate fluid communication between the annulus 126 and the interior of the work string 114 such that stimulation and production operations may be undertaken in each corresponding interval 128*a*, 128*b*, and 128*c* of the formation 108.

According to the present disclosure, to move the sliding sleeve 132 of a given sliding sleeve assembly 130*a*, 130*b*, and 130*c* to its open position, and thereby expose the corresponding ports 134, one or more wellbore darts 136 (shown as a first wellbore dart 136*a* and a second wellbore dart 136*b*) may be introduced into the work string 114 and conveyed downhole toward the sliding sleeve assemblies 130*a*, 130*b*, and 130*c*. The wellbore darts 136 may be conveyed through the work string 114 and to the completion assembly 120 by any known technique.

For example, the wellbore darts 136 can be dropped through the work string 114 from the surface 104, pumped by flowing fluid through the interior of the work string 114, self-propelled, conveyed by wireline, slickline, coiled tubing, etc.

Each wellbore dart 136 may be detectable by one or more sensors 138 (shown as sensors 138*a*, 138*b*, and 138*c*) associated with each sliding sleeve assembly 130*a*, 130*b*, and 130*c*. In some embodiments, for instance, the wellbore darts 136 may exhibit known magnetic properties, produce a known magnetic field, pattern, or combination of magnetic fields or any combination thereof, which is/are detectable by the sensors 138*a*, 138*b*, and 138*c*. In such cases, each sensor 138*a*, 138*b* and 138*c* may be capable of detecting the presence of the magnetic field(s) produced by the wellbore darts 136, one or more other magnetic properties of the well bore darts 136, or both. Suitable magnetic sensors 138*a*, 138*b* and 138*c* can include, but are not limited to, magneto-resistive sensors, Hall-effect sensors, conductive coils, combinations thereof, and the like. In some embodiments, permanent magnets can be combined with one or more of the sensors 138*a*, 138*b*, and 138*c* to create a magnetic field that is disturbed by the wellbore darts 136, and a detected change in the magnetic field can be an indication of the presence of the wellbore darts 136.

Moreover, in some embodiments, each sensor 138*a*, 138*b*, and 138*c* may include a barrier (not shown) positioned between the sensor 138*a*, 138*b* and 138*c* and the well bore darts 136. The barrier may comprise a relatively low magnetic permeability material and may be configured to allow magnetic signals to pass therethrough and isolate pressure between the sensor 138*a*, 138*b*, and 138*c* and the wellbore darts 136. Additional information on such a barrier as used in magnetic detection can be found in U.S. Patent Pub. No. 2013/0264051. In other embodiments, a magnetic shield (not shown) may be positioned either on the wellbore darts 136 or near the sensors 138*a*, 138*b*, and 138*c* to "short circuit" magnetic fields emitted by the wellbore darts 136 and thereby reduce the amount of remnant magnetic fields that may be detectable by the sensors 138*a*, 138*b*, and 138*c*. In such embodiments, the magnetic field may be pulled toward materials that have a high magnetic permeability, which effectively shields the sensors 138*a*, 138*b*, and 138*c* from the remnant magnetic fields.

In other embodiments, one or more of the sensors 138*a*, 138*b* and 138*c* may be capable of detecting radio frequencies emitted by the wellbore darts 136. In such embodiments, the sensors 138*a*, 138*b*, and 138*c* may be radio frequency (RF) sensors or readers capable of detecting a radio frequency identification (RFID) tag secured to or otherwise forming part of the wellbore darts 136. The RF sensors 138*a*, 138*b*, and 138*c* may be configured to sense the RFID tags as the wellbore darts 136 traverse the work string 114 and encounter the RF sensors 138*a*, 138*b*, and 138*c*. In at least one embodiment, the RF sensors 138*a*, 138*b* and 138*c* may be micro-electromechanical systems (MEMS) or devices capable of sensing radio frequencies. In such cases, the MEMS sensors may include or otherwise encompass an RF coil and thereby be used as the sensors 138*a*, 138*b*, and 138*c*. The RF sensor 138*a*, 138*b*, and 138*c* may alternatively be a near field communication (NFC) sensor capable of establishing radio communication with a corresponding dummy tag arranged on the wellbore darts 136. When the dummy tags come into proximity of the RF sensors 138*a*, 138*b*, and 138*c*, the RF sensors 138*a*, 138*b*, and 138*c* may register the presence of the wellbore darts 136.

In yet other embodiments, the sensors 138*a*, 138*b*, and 138*c* may be a type of mechanical switch or the like that may be mechanically manipulated through physical contact with the wellbore darts 136 as they traverse the work string 114. In some cases, for instance, the mechanical sensors 138*a*, 138*b*, and 138*c* may be ratcheting or mechanical counting devices or switches disposed near each sleeve 132. Upon physically contacting and otherwise interacting with the wellbore darts 136, the mechanical sensors 138*a*, 138*b*, and 138*c* may be configured to generate and send corresponding signals indicative of the same to an adjacent actuation device (not shown in FIG. 1), as will be described below. In some embodiments, the mechanical sensors 138*a*, 138*b*, and 138*c* may be spring loaded or otherwise configured such that after the wellbore dart 136 has passed (or following a certain time period thereafter) the switch may autonomously reset itself. As will be appreciated, such a resettable embodiment may allow the mechanical sensors 138*a*, 138*b*, 138*c* to physically interact with multiple wellbore darts 136.

Each sensor 138*a*, 138*b*, and 138*c* may be connected to associated electronic circuitry (not shown in FIG. 1) configured to determine whether the associated sensor 138*a*, 138*b*, and 138*c* has positively detected a wellbore dart 136. For instance, in the case where the sensors 138*a*, 138*b*, and 138*c* are magnetic sensors, the sensors 138*a*, 138*b*, and 138*c* may detect a particular or predetermined magnetic field, or pattern or combination of magnetic fields, or other magnetic properties of the wellbore darts 136, and the associated electronic circuitry may have the predetermined magnetic field(s) or other magnetic properties programmed into non-volatile memory for comparison. Similarly, in the case where the sensors 138*a*, 138*b*, and 138*c* are RF sensors, the sensors 138*a*, 138*b*, and 138*c* may detect a particular RF signal from the wellbore darts 136, and the associated electronic circuitry may either count the RF signals or compare the RF signals with RF signals programmed into its non-volatile memory.

Once a wellbore dart 136 is positively detected by the sensors 138*a*, 138*b*, and 138*c*, the associated electronic circuitry may acknowledge and count the detection instance and, if appropriate, trigger actuation of the corresponding sliding sleeve assembly 130*a*, 130*b*, and 130*c* using one or more associated actuation devices (not shown in FIG. 1). In some embodiments, for example, actuation of the associated sliding sleeve assembly 130*a*, 138*b*, and 138*c* may not be triggered until a predetermined number or combination of well-bore darts 136 has been detected by the given sensors 138*a*, 138*b*, and 138*c*. Accordingly, each sensor 138*a*, 138*b* and 138*c* records and counts the passing of each wellbore dart 136 and, once a predetermined number of wellbore darts 136 is detected by a given sensor 138*a*, 138*b*, and 138*c*, the corresponding sliding sleeve assembly 130*a*, 130*b*, and 130*c* may then be actuated in response thereto.

The completion assembly 120 may include as many sliding sleeve assemblies 130*a*, 130*b*, and 130*c* as required to undertake a desired fracturing or stimulation operation in the subterranean formation 108. The electronic circuitry of each sliding sleeve assembly 130*a*, 130*b*, and 130*c* may be programmed with a predetermined wellbore dart 136 "count." Upon reaching or otherwise registering the predetermined wellbore dart 136 count, each sliding sleeve assembly 130*a*, 130*b*, and 130*c* may then be actuated. More particularly, the electronic circuitry associated with the third sliding sleeve assembly 130*c* may require the detection and counting of one wellbore dart 136 before actuating the third sliding sleeve assembly 130*c*; the electronic circuitry associated with the second sliding sleeve assembly 130*b* may require the detection and counting of two wellbore darts 136 before actuating the second sliding sleeve assembly 130*b*; and the electronic circuitry associated with the first sliding sleeve assembly 130*a* may require the detection and counting of three wellbore darts 136 before actuating the first sliding sleeve assembly 130*a*.

In the illustrated embodiment, the first wellbore dart 136*a* has been introduced into the work string 114 and conveyed past each of the sensors 138*a*, 138*b*, and 138*c* such that each sensor 138*a*, 138*b*, and 138*c* is able to detect the wellbore dart 136*a* and increase its wellbore dart "count" by one. Since the electronic circuitry associated with the third sliding sleeve assembly 130*c* is pre-programmed with a predetermined "count" of one wellbore dart, upon detecting the first wellbore dart 136*a*, the sliding sleeve 132 of the third sliding sleeve assembly 130*c* may be actuated to the open position. Upon conveying the second wellbore dart 136*b* into the work string 114, the first and second sensors 138*a*, 138*b* are able to detect the second wellbore dart 136*b* and increase their respective wellbore dart "counts" to two. Since the electronic circuitry associated with the second sliding sleeve assembly 130*b* is pre-programmed with a predetermined "count" of two wellbore darts, upon detecting the second wellbore dart 136*b*, the sliding sleeve 132 of the second sliding sleeve assembly 130*b* may be actuated to the open position. Upon conveying a third wellbore dart (not shown) into the work string 114, the first sensor 138*a* is able to detect the third wellbore dart and increase its wellbore dart "count" to three. Since the electronic circuitry associated with the first sliding sleeve assembly 130*a* is preprogrammed with a predetermined "count" of three well bore darts, upon detecting the third wellbore dart, the sliding sleeve 132 of the first sliding sleeve assembly 130*a* may be actuated to the open position.

Figure 2A:
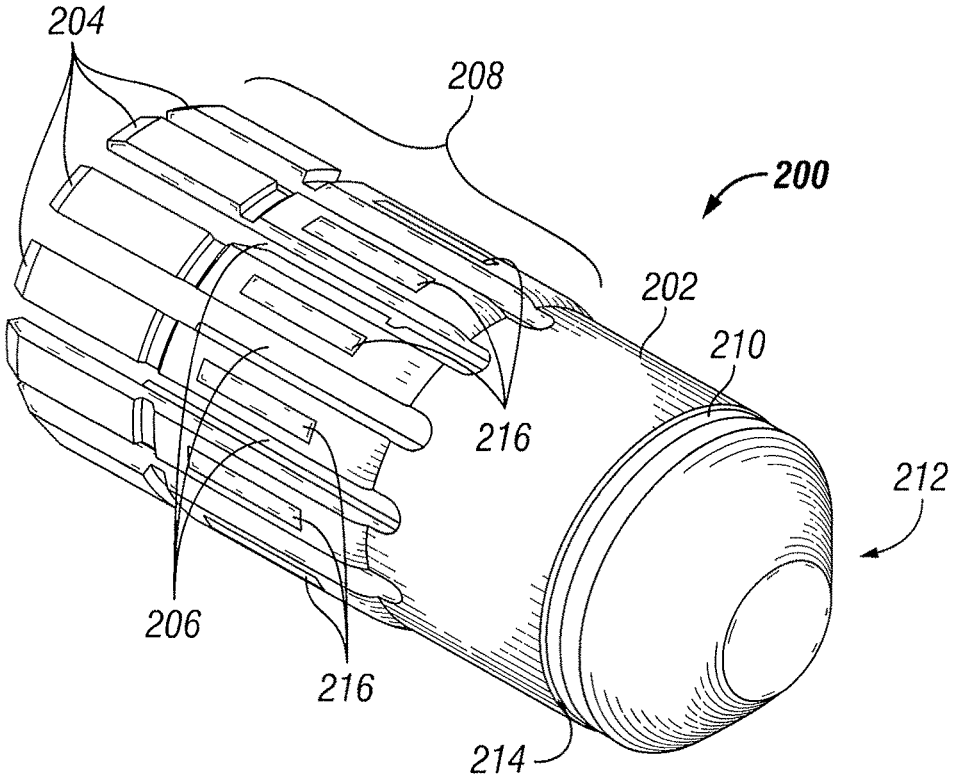
FIGS. 2A and 2B illustrate an exemplary wellbore projectile in the form of a wellbore dart, according to one or more embodiments of the present disclosure.
Figure 2B:
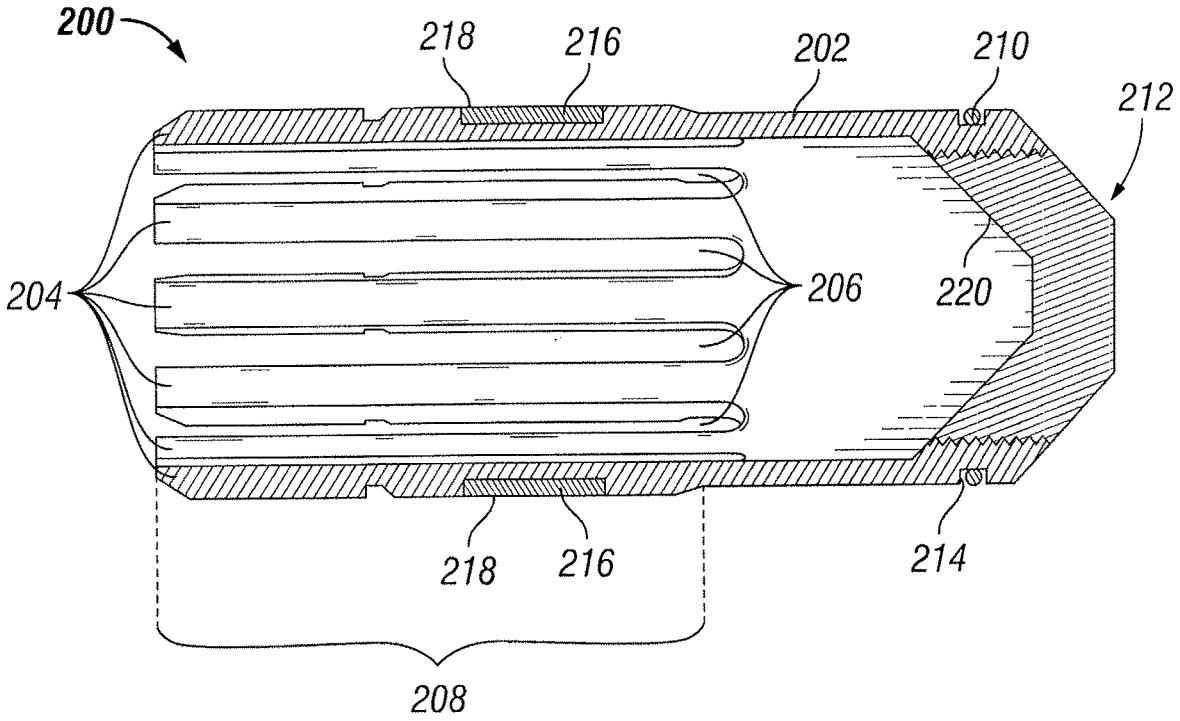

Referring now to FIGS. 2A and 2B, illustrated is an exemplary wellbore dart 200, according to one or more embodiments of the present disclosure. The wellbore dart 200 may be similar to the wellbore darts 136 of FIG. 1, and therefore may be configured to be introduced downhole to interact with the sensors 138*a-c* of the sliding sleeve assemblies 130*a*, 130*b*, and 130*c*. FIG. 2A depicts an isometric view of the wellbore dart 200, and FIG. 2B depicts a cross-sectional side view of the wellbore dart 200. As illustrated, the wellbore dart 200 may include a generally cylindrical body 202 with a plurality of collet fingers 204 either forming part of the body 202 or extending longitudinally therefrom. The body 202 may be made of a variety of materials including, but not limited to, iron and iron alloys, steel and steel alloys, aluminum and aluminum alloys, magnesium and magnesium alloys, copper and copper alloys, plastics, composite materials, and any combination thereof. In other embodiments, as described in greater detail below, all or a portion of the body 202 may be made of a degradable or dissolvable material, without departing from the scope of the disclosure. In one or more embodiments, the wellbore dart 200 may have a spherical or spheroidal body.

In at least one embodiment, the collet fingers 204 may be flexible, axial extensions of the body 202 that are separated by elongate channels 206. A dart profile 208 may be defined on the outer radial surface of the body 202, such as on the collet fingers 204. The dart profile 208 may include or otherwise provide various features, designs, configurations and any combination thereof that enable the wellbore dart 200 to mate with a corresponding sleeve mating profile (not shown) defined on a desired sliding sleeve (e.g., the sliding sleeves 132 of FIG. 1).

The wellbore dart 200 may further include a dynamic seal 210 arranged about the exterior or outer surface of the body 202 at or near its downhole end 212. As used herein, the term "dynamic seal" is used to indicate a seal that provides pressure, fluid isolation, or both between members that have relative displacement therebetween, for example, a seal that seals against a displacing surface, or a seal carried on one member and sealing against the other member. In some embodiments, the dynamic seal 210 may be arranged within a groove 214 defined on the outer surface of the body 202. The dynamic seal 210 may be made of a material selected from the following: elastomeric materials, non-elastomeric materials, metals, composites, rubbers, ceramics, derivatives thereof, and any combination thereof. In some embodiments, as depicted in FIG. 2B, the dynamic seal 210 may be an 0-ring or the like. In other embodiments, however, the dynamic seal 210 may be a set of v-rings or CHEVRON® packing rings, or other appropriate seal configurations (e.g., seals that are round, v-shaped, u-shaped, square, oval, t-shaped, etc.), as generally known to those skilled in the art, or any combination thereof. As described more below, the dynamic seal 210 may be configured to "dynamically" seal against a seal bore of a sliding sleeve (not shown).

The wellbore dart 200 may further include or otherwise encompass one or more detectable sensor components 216. As used herein, the term "sensor component" refers to any mechanism, device, element, or substance that is able to interact with the sensors 138*a*, 138*b*, and 138*c* of the sliding sleeve assemblies 130*a*, 130*b*, and 130*c* of FIG. 1 and thereby confirm that the wellbore dart 200 has come into proximity of a given sensor 138*a*, 138*b*, and 138*c*. For example, in some embodiments, the sensor components 216 may be magnets configured to interact with magnetic sensors 138*a*, 138*b*, and 138*c*, as described above. In other embodiments, however, the sensor components 216 may be RFID tags (active or passive) that may be read or otherwise detected by a corresponding RFID reader associated with or otherwise encompassing the sensors 138*a*, 138*b*, and 138*c*.

In some embodiments, the sensor components 216 may be arranged about the circumference of the wellbore dart 200, such as being positioned on one or more of the collet fingers 204. As best seen in FIG. 2B, the sensor components 216 may seated or otherwise secured within corresponding recesses 218 (FIG. 2B) defined in the collet fingers 204. In other embodiments, however, the sensor components 216 may be secured to the outer radial surface of the collet fingers 204. In yet other embodiments, the sensor components 216 may be positioned on the body 202 at or near the downhole end 212 or positioned on a combination of the body 202 and the collet fingers 204. In even further embodiments, the wellbore dart 200 itself may be or otherwise encompass the sensor component 216. In other words, in some embodiments, the wellbore dart 200 itself may be made of a material (for example, magnets) or otherwise comprise a mechanism, device (for example, RFID tag), element, or substance that is able to interact with the sensors 138*a-c* of the sliding sleeve assemblies 130*a*, 130*b*, and 130*c* of FIG. 1 and thereby confirm that the wellbore dart 200 has come into proximity of the given sensor 138*a*, 138*b*, and 138*c*.

Figure 3A:
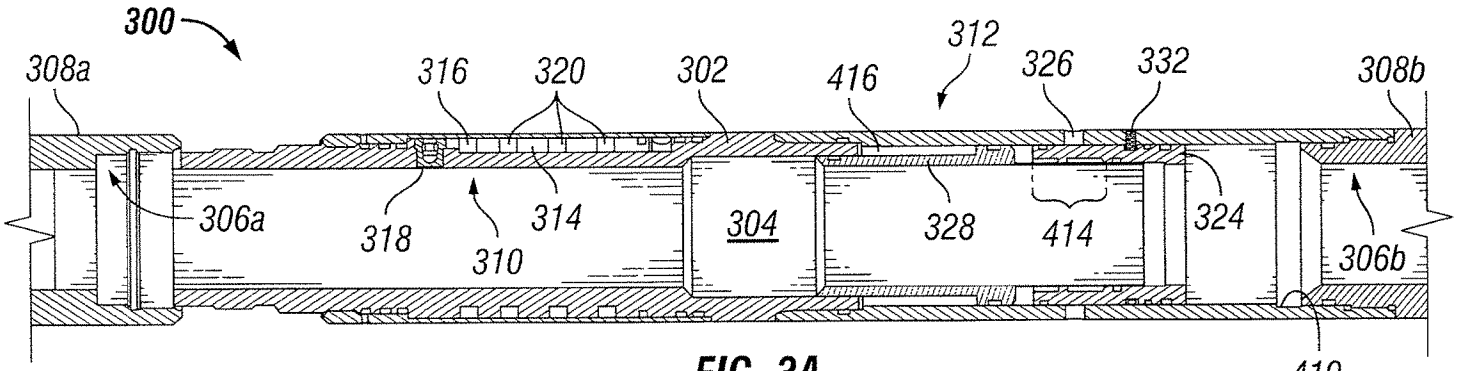
FIGS. 3A, 3B, and 3C illustrate cross-sectional side views of an exemplary sliding sleeve assembly, according to one or more embodiments.
Figure 3B:
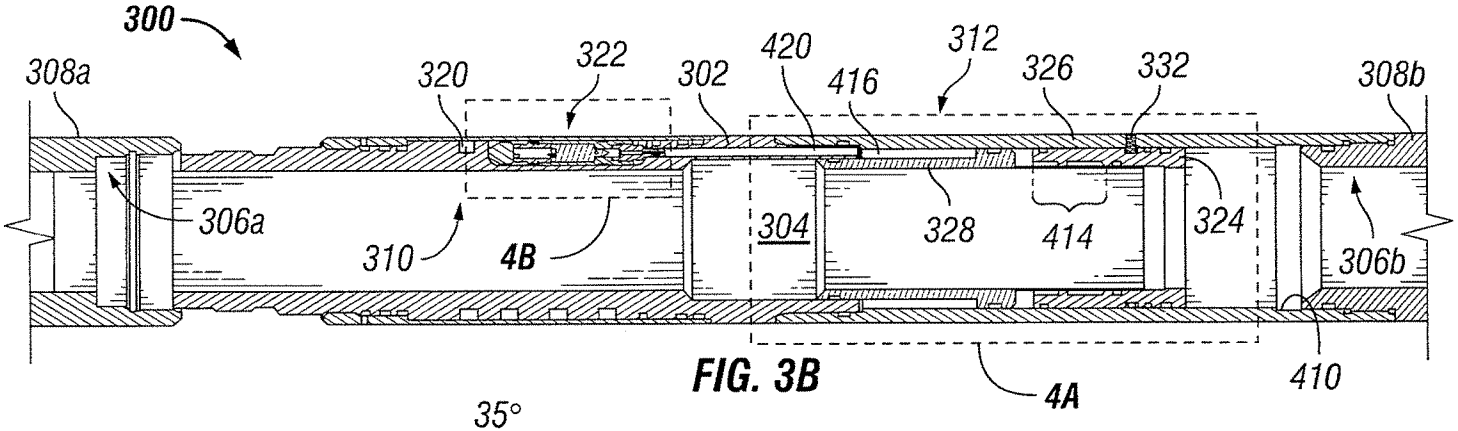
Figure 3C:
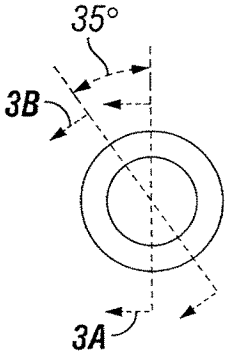

Referring now to FIGS. 3A and 3B, illustrated are cross-sectional side views of an exemplary sliding sleeve assembly 300, according to one or more embodiments. With reference to the cross-sectional angular indicator provided at the center of the page, FIG. 3A provides a cross-sectional side view of the sliding sleeve assembly 300 (hereafter "the assembly 300") along a vertical line, and FIG. 3B provides a cross-sectional view of the assembly 300 along a line offset from vertical by 35° (as illustrated by FIG. 3C). The assembly 300 may be similar in some respects to any of the sliding sleeve assemblies 130*a*, 130*b*, 130*c* of FIG. 1. As illustrated, the assembly 300 may include an elongate completion body 302 that defines an inner flow passageway 304. The completion body 302 may have a first end 306*a* coupled to an upper sub 308*a* and a second end 306*b* coupled to a lower sub 308*b*. The assembly 300 may form part of a downhole completion, such as the completion assembly 120 of FIG. 1. Accordingly, the upper and lower subs 308*a*, 308*b* may be used to couple the completion body 302 to corresponding upper and lower portions of the completion assembly 120, the work string 114, or both (FIG. 1).

In some embodiments, the completion body 302 may include an electronics sub 310 and a ported sub 312. The electronics sub 310 may be threaded or otherwise mechanically fastened to the ported sub 312 so that the completion body 302 forms a continuous, elongate, and cylindrical structure. In other embodiments, the electronics sub 310 and the ported sub 312 may be integrally formed as a monolithic structure, without departing from the scope of the disclosure.

As best seen in FIG. 3A, the electronics sub 310 may define or otherwise provide an electronics cavity 314 that houses electronic circuitry 316, one or more sensors 318, and one or more batteries 320 (three shown). As best seen in FIG. 3B, the electronics sub 310 may further provide an actuator 322 (FIG. 3B). The batteries 320 may provide power to operate the electronic circuitry 316, the sensor(s) 318, and the actuator 322. The sensor(s) 318 may be similar to the sensors 138*a*, 138*b*, and 138*c* of FIG. 1, and therefore may be capable of detecting a wellbore dart (not shown) that traverses the assembly 300 via the inner flow passageway 304.

The ported sub 312 may include a sliding sleeve 324, one or more ports 326 (FIG. 3A), and an actuation sleeve 328. The sliding sleeve 324 may be similar to the sliding sleeves 132 of FIG. 1 and may be movably arranged within the ported sub 312. The ports 326 may be similar to the ports 134 of FIG. 1 and may be defined through the ported sub 312 to enable fluid communication between the inner flow passageway 304 and an exterior of the ported sub 312, such as a surrounding subterranean formation (for example, the formation 108 of FIG. 1). In FIGS. 3A and 3B, the sliding sleeve 324 is depicted in a closed position, where the sliding sleeve 324 generally occludes the ports 326 and thereby prevents fluid communication therethrough. As described below, however, the sliding sleeve 324 can be moved axially within the ported sub 312 to an open position, where the ports 326 are exposed and thereby facilitate fluid communication therethrough.

Figure 4A:
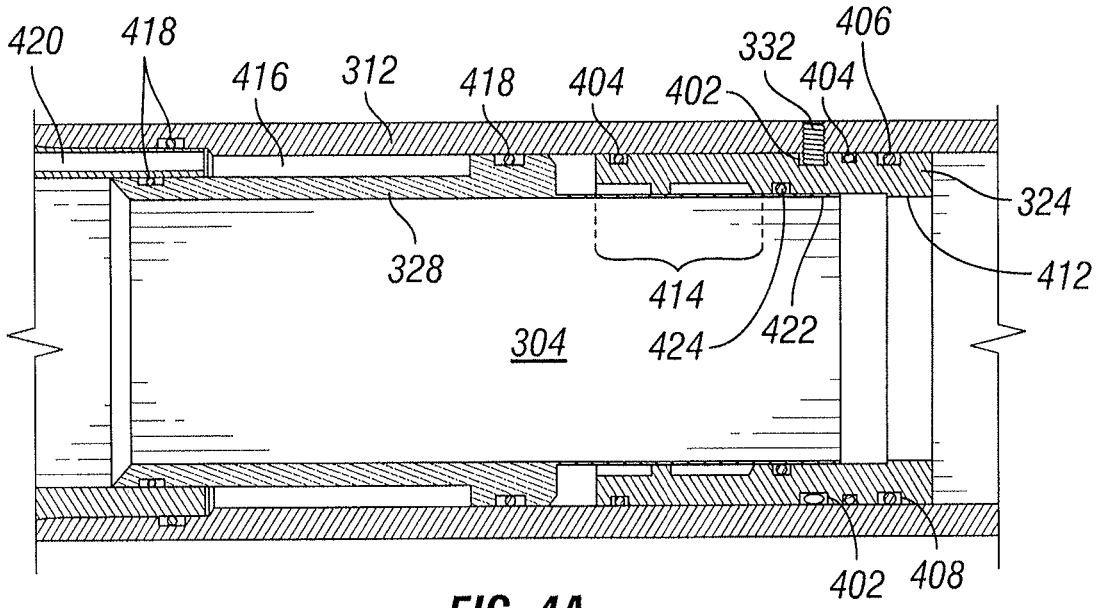
FIG. 4A is an enlarged view of the sliding sleeve and the actuation sleeve of FIGS. 3A and 3B, according to one or more embodiments of the present disclosure.

Referring to FIG. 4A, illustrated is an enlarged view of the sliding sleeve 324 and the actuation sleeve 328, as indicated by the labeled dashed line provided in FIG. 3B. In some embodiments, the sliding sleeve 324 may be secured in the closed position with one or more shearable devices 332 (one shown). In the illustrated embodiment, the shearable devices 332 may include one or more shear pins that extend from the ported sub 312 (for example, the completion body 302) and into corresponding blind bores 402 defined on the outer surface of the sliding sleeve 324. In other embodiments, the shearable device(s) 332 may be a shear ring or any other device or mechanism configured to shear or otherwise fail upon assuming a predetermined shear load applied to the sliding sleeve 324.

The sliding sleeve 324 may further include one or more dynamic seals 404 (two shown) arranged between the outer surface of the sliding sleeve 324 and the inner surface of the ported sub 312. The dynamic seals 404 may be configured to provide fluid isolation between the sliding sleeve 324 and the ported sub 312 and thereby prevent fluid migration through the ports 326 (FIG. 3A) and into the inner flow passageway 304 when the sliding sleeve 324 is in the closed position. The dynamic seals 404 may be similar to the dynamic seal 210 of FIGS. 2A and 2B, and therefore will not be described again. In at least one embodiment, as illustrated, one or both of the dynamic seals 404*a,b* may be an O-ring.

In some embodiments, the sliding sleeve 324 may further include a lock ring 406 disposed or positioned within a lock ring groove 408 defined in the sliding sleeve 324. The lock ring 406 may be an expandable C-ring, for example, that expands upon locating a lock ring mating groove 410 (FIGS. 3A and 3B). Accordingly, as the sliding sleeve 324 moves to its open position, as described below, the lock ring 406 may locate and expand into the lock ring mating groove 410, and thereby prevent the sliding sleeve 324 from moving back to the closed position.

The sliding sleeve 324 may further provide a seal bore 412 and a sleeve mating profile 414 defined on the inner radial surface of the sliding sleeve 324. As illustrated, the seal bore 412 may be arranged downhole from the sleeve mating profile 414, but may equally be arranged on either end (or at an intermediate location) of the sliding sleeve 324, without departing from the scope of the disclosure. As described below, the dart profile 208 of the wellbore dart 200 of FIGS. 2A and 2B may be configured to match or otherwise correspond to the sleeve mating profile 414 of the sliding sleeve 324.

Figure 5A:
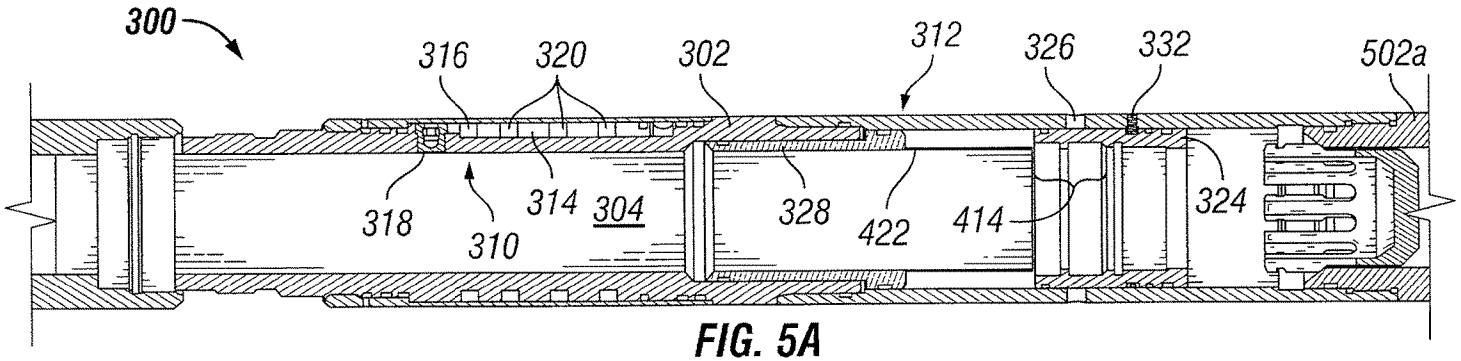
FIGS. 5A, 5B, and 5C illustrate progressive cross-sectional side views of the assembly of FIGS. 3A and 3B, according to one or more embodiments of the present disclosure.
Figure 5B:
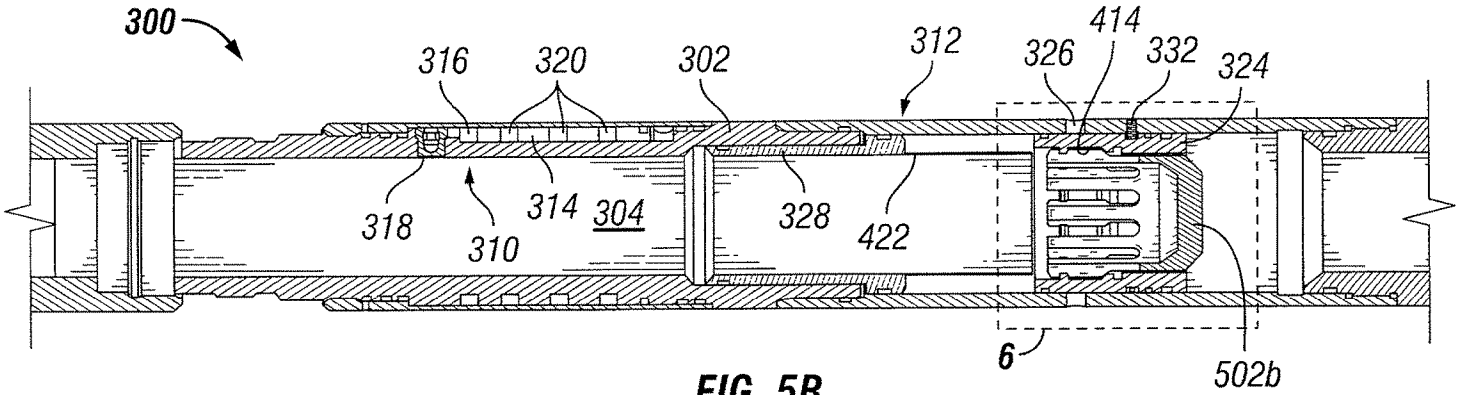
Figure 5C:
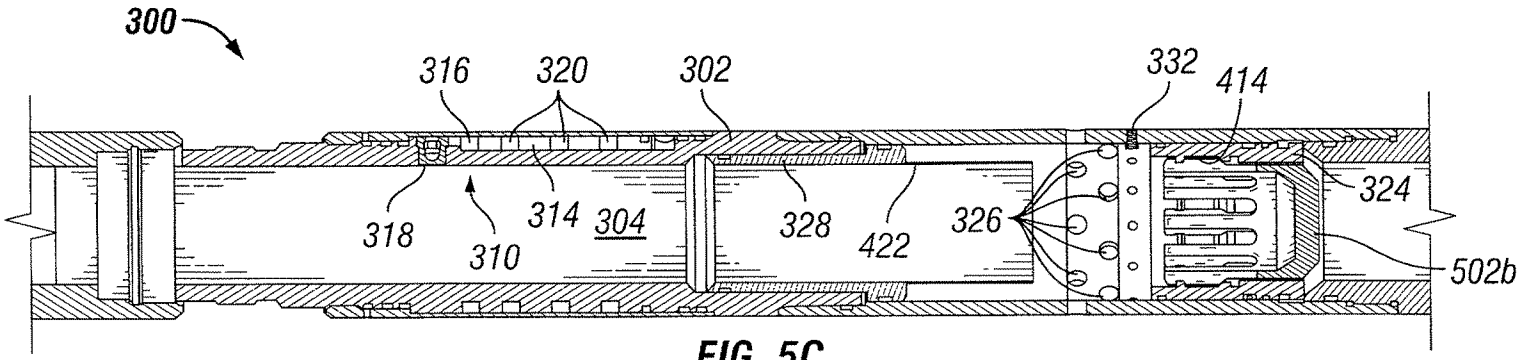

The actuation sleeve 328 may also be movably arranged within the ported sub 312 between a run-in configuration, as shown in FIGS. 3A and 3B and FIG. 4A, and an actuated configuration, as shown in FIGS. 5A, 5B, and 5C. In some embodiments, a hydraulic cavity 416 may be defined between the actuation sleeve 328 and the ported sub 312 (for example, the completion body 302) and sealed at each end with appropriate sealing devices 418, such as 0-rings or the like. In such embodiments, the hydraulic cavity 416 may be fluidly coupled to the electronics cavity 314 (FIG. 3A) via one or more hydraulic conduits 420. The hydraulic cavity 416 may be filled with a hydraulic fluid, such as silicone oil, and maintained at an increased pressure with respect to the electronics cavity 314, which may be at ambient pressure.

The actuation sleeve 328 may have or otherwise provide an axial extension 422 that extends within at least a portion of the sliding sleeve 324. When the actuation sleeve 328 is in its run-in configuration, as shown in FIG. 4A, the axial extension 422 may be configured to cover or otherwise occlude the sleeve mating profile 414. As a result, any wellbore darts passing through the inner flow passageway 304 may be unable to mate with the sleeve mating profile 414. A wiper ring 424, such as an 0-ring or the like, may be arranged between the axial extension 422 and the inner radial surface of the sliding sleeve 324 to protect the sleeve mating profile 414 by preventing debris and sand from entering the sleeve mating profile 414.

Figure 4B:
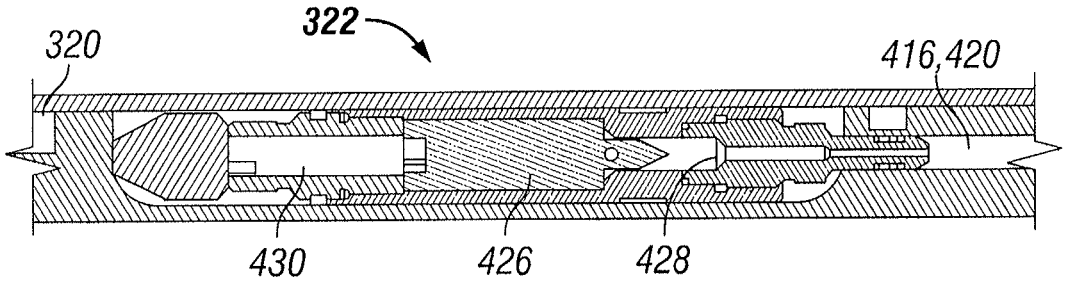
FIG. 4B is an enlarged view of an exemplary actuation device, according to one or more embodiments of the present disclosure.

Referring to FIG. 4B, illustrated is an enlarged view of the actuator 322, as indicated by the labeled dashed line provided in FIG. 3B. The actuator 322 may be any mechanical, electro-mechanical, hydraulic, or pneumatic actuation device capable of manipulating the configuration or position of the actuation sleeve 328. Accordingly, the actuator 322 may be any device that can be used or otherwise triggered to move the actuation sleeve 328 from its run-in configuration (FIGS. 3A and 3B and FIG. 4A) to its actuated configuration (FIGS. 5A, 5B, and 5C). In the illustrated embodiment, the actuator 322 is an electro-hydraulic piston lock that includes a thruster 426 and a frangible member 428. The frangible member 428 may be, for example, a burst disk or pressure barrier that prevents the pressurized hydraulic fluid within the hydraulic cavity 416 from escaping into the electronics cavity 314 (FIG. 3A) via the hydraulic conduit 420 (FIGS. 3B and 4A). Accordingly, a pressure differential between the electronics and hydraulic cavities 314, 416 is maintained across the frangible member 428 while intact.

The thruster 426 may be communicably coupled to the electronic circuitry 316 (FIG. 3A), which, as described above, is communicably coupled to the sensor(s) 318. When the sensor(s) 318 positively detects a wellbore dart, or a predetermined number of wellbore darts, the electronic circuitry 316 may send an actuation signal to the actuator 322.

The actuator 322 may include a chemical charge 430 that is fired upon receiving the actuation signal, and firing the chemical charge 430 may force the thruster 426 into the frangible member 428 to rupture or penetrate the frangible member 428. Upon rupturing the frangible member 428, the pressurized hydraulic fluid within the hydraulic cavity 416 is able to escape into the electronics cavity 314 via the hydraulic conduit 420 in seeking pressure equilibrium.

Referring again to FIG. 3B, as the pressurized hydraulic fluid within the hydraulic cavity 416 seeks pressure equilibrium by rushing into the electronics cavity 314, a pressure differential is generated across the actuation sleeve 328. This generated pressure differential may result in the actuation sleeve 328 moving to its actuated configuration in the uphole direction (for example, to the left in FIG. 3B), as shown in FIGS. 5A, 5B, and 5C. Moving the actuation sleeve 328 to the actuated configuration may uncover the sleeve mating profile 414 (FIG. 4A).

Referring again to FIG. 3A and additionally to FIGS. 5A, 5B, and 5C, exemplary operation of the assembly 300 is now provided. More particularly, FIGS. 3A and 5A, 5B, and 5C depict progressive cross-sectional views of the assembly 300 during actuation of the sliding sleeve 324 as it moves between its closed and open positions. It will be appreciated that operation of the assembly 300 may be equally descriptive of operation of any of the sliding sleeve assemblies 130*a*, 130*b*, and 130*c* of FIG. 1.

In FIG. 3A, the assembly 300 is depicted in a "run-in" or closed configuration, where the sliding sleeve 324 generally occludes the ports 326 defined in the completion body 302 of the assembly 300.

In FIG. 5A, a first wellbore dart 502*a* is depicted as having been introduced into the work string 114 (FIG. 1) and conveyed to and through the assembly 300. The first well bore dart 502*a* may be similar to the wellbore dart 200 of FIGS. 2A and 2B, and therefore will not be described again. As illustrated, the first wellbore dart 502*a* has passed through the inner flow passageway 304 downhole from the sensor 318 and is proceeding in a downhole direction (for example, to the right in FIG. 5A). In some embodiments, the first wellbore dart 502*a* may be pumped to the assembly 300 from the surface 104 (FIG. 1) using hydraulic pressure. In other embodiments, the first wellbore dart 502*a* may be dropped through the work string 114 (FIG. 1) from the surface 104 until locating the assembly 300. In yet other embodiments, the first wellbore dart 502*a* may be conveyed through the work string 114 by wireline, slickline, coiled tubing, etc., or it may be self-propelled until locating the assembly 300. In even further embodiments, any combination of the foregoing techniques may be employed to convey to the first wellbore dart 502*a* to the assembly 300.

As the first wellbore dart 502*a* passes by the sensor 318, or comes into close proximity therewith, the sensor 318 may detect the presence of the first wellbore dart 502*a* and send a detection signal to the electronic circuitry 316 indicating the same. The electronic circuitry 316, in turn, may register a "count" of the first well bore dart 502*a* and a total running count of how many well bore darts (including the first well bore dart 502*a*) have bypassed the assembly 300. When a predetermined number of wellbore darts (including the first wellbore dart 502*a*) have been counted, the electronic circuitry 316 may be programmed to actuate the assembly 300. More particularly, when the predetermined number of wellbore darts has been detected and otherwise registered, the electronic circuitry 316 may send an actuation signal to the actuator 322 (FIGS. 3B and 4B), which operates to move the actuation sleeve 328 from the run-in configuration, as shown in FIG. 3A, to the actuated configuration, as shown in FIGS. 5A, 5B, and 5C.

In some embodiments, as mentioned above, the actuator 322 may be any mechanical, electro-mechanical, hydraulic, or pneumatic actuation device capable of displacing the actuation sleeve 328 from the run-in configuration to the actuated configuration. In other embodiments, however, as described above with reference to FIG. 4B, the actuator 322 may be an electro-hydraulic piston lock that includes the thruster 426 and the frangible member 428 that provides a pressure barrier between the electronics cavity 314 and the hydraulic cavity 416. Upon receiving the actuation signal, the thruster 426 penetrates the frangible member 428 and the pressurized hydraulic fluid within the hydraulic cavity 416 escapes into the electronics cavity 314 via the hydraulic conduit 420 as it seeks pressure equilibrium. As the hydraulic fluid escapes the hydraulic cavity 416, a pressure differential is generated across the actuation sleeve 328 that urges the actuation sleeve 328 to move to the actuation configuration.

Referring to FIG. 5A, as the actuation sleeve 328 moves to its actuation configuration, the sleeve mating profile 414 gradually becomes exposed to the inner flow passageway 304 as the axial extension 422 of the actuation sleeve 328 moves in the uphole direction. With the sleeve mating profile 414 exposed, any subsequent wellbore dart that is introduced into the inner flow passageway 304 may be able to mate with the sleeve mating profile 414.

FIG. 5B shows a second wellbore dart 502*b* as having been introduced into the work string 114 (FIG. 1) and conveyed to the assembly 300. Similar to the first wellbore dart 502*a* (FIG. 5A), the second wellbore dart 502*b* may be similar to the well bore dart 200 of FIGS. 2A and 2B and therefore will not be described again. Moreover, the first and second wellbore darts 502*a*, 502*b* may exhibit the same dart profile (for example, the dart profile 208 of FIGS. 2A and 2B). Upon locating the assembly 300, the second wellbore dart 502*b* may be configured to mate with the sliding sleeve 324.

Figure 6:
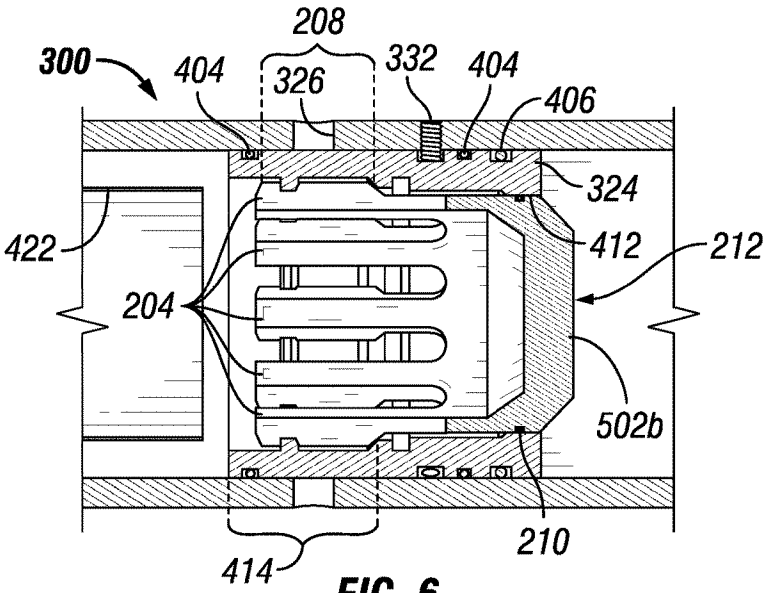
FIG. 6 is an enlarged view of a wellbore dart mating with a sliding sleeve, according to one or more embodiments of the present disclosure.

Referring briefly to FIG. 6, illustrated is an enlarged view of the second wellbore dart 502*b* as it mates with the sliding sleeve 324, as indicated in the dashed area of FIG. 5B, according to one or more embodiments. Upon locating the assembly 300, the downhole end 212 of the second wellbore dart 502*b* may be configured to enter the seal bore 412 provided on the inner radial surface of the sliding sleeve 324. The dynamic seal 210 of the second wellbore dart 502*b* may be configured to engage and seal against the seal bore 412, thereby allowing fluid pressure behind the second wellbore dart 502*b* to increase.

The dart profile 208 of the second wellbore dart 502*b* may be configured to match or otherwise correspond to the sleeve mating profile 414 of the sliding sleeve 324. Accordingly, upon locating the assembly 300, the dart profile 208 may mate with and otherwise engage the sleeve mating profile 414, thereby effectively stopping the downhole progression of the second wellbore dart 502*b*. Once the dart profile 208 axially and radially aligns with the sleeve mating profile 414, the collet fingers 204 of the second wellbore dart 502*b* may be configured to spring radially outward and thereby mate the second wellbore dart 502*b* to the sliding sleeve 324.

Referring again to FIGS. 5A, 5B, and 5C and, more particularly, to FIG. 5C, with the dart profile 208 successfully mated with the sleeve mating profile 414, an operator may increase the fluid pressure within the work string 114 (FIG. 1) and the inner flow passageway 304 uphole from the second wellbore dart 502*b* to move the sliding sleeve 324 to the open position.

The dynamic seal 210 (FIG. 6) of the second wellbore dart 502*b* may be configured to substantially prevent the migration of high-pressure fluids past the second wellbore dart 502*b* in the downhole direction. As a result, fluid pressure uphole from the second wellbore dart 502*b* may be increased. Moreover, the one or more shearable devices 332 may be configured to maintain the sliding sleeve 324 in the closed position until assuming a predetermined shear load. As the fluid pressure increases within the inner flow passageway 304, the increased pressure acts on the second wellbore dart 502*b*, which, in turn, acts on the sliding sleeve 324 via the mating engagement between the dart profile 208 and the sleeve mating profile 414. Accordingly, increasing the fluid pressure within the work string 114 (FIG. 1) may serve to increase the shear load assumed by the shearable devices 332 holding the sliding sleeve 324 in the closed position.

The fluid pressure may increase until reaching a predetermined pressure threshold, which results in the predetermined shear load being assumed by the shearable devices 332 and their subsequent failure. Once the shearable devices 332 fail, the sliding sleeve 324 may be free to axially translate within the ported sub 312 to the open position, as shown in FIG. 5C. With the sliding sleeve 324 in the open position, the ports 326 are exposed and a well operator may then be able to perform one or more well bore operations, such as stimulating a surrounding formation (for example, the formation 108 of FIG. 1).

Following stimulation operations, in at least one embodiment, a drill bit or mill (not shown) may be introduced downhole to drill out the second wellbore dart 502*b*, thereby facilitating fluid communication past the assembly 300. While important, those skilled in the art will readily recognize that this process requires valuable time and resources. According to the present disclosure, however, the wellbore darts may be made at least partially of a dissolvable or degradable material to obviate the time-consuming requirement of drilling out wellbore darts in order to facilitate fluid communication therethrough. As used herein, the term "degradable material" refers to any material or substance that is capable of or otherwise configured to degrade or dissolve following the passage of a predetermined amount of time or after interaction with a particular downhole environment (for example, temperature, pressure, downhole fluid, etc.), treatment fluid, etc.

Referring again to FIG. 2B, for example, in some embodiments, the entire wellbore dart 200 may be made of a degradable material. In other embodiments, only a portion of the wellbore dart 200 may be made of the degradable material. For instance, in some embodiments, all or a portion of the downhole end 212 of the body 202 may be made of the degradable material. As illustrated, for example, the body 202 may further include a tip 220 that forms an integral part of the body 202 or is otherwise coupled thereto. In the illustrated embodiment, the tip 220 may be threadably coupled to the body 202. In other embodiments, however, the tip 220 may alternatively be welded, brazed, adhered, or mechanically fastened to the body 202, without departing from the scope of the disclosure. After stimulation operations have completed, the degradable material may be configured to dissolve or degrade, thereby leaving a full-bore inner diameter through the sliding sleeve assemblies 130*a*, 130*b* and, 130*c* (FIG. 1) without the need to mill or drill out.

Suitable degradable materials that may be used in accordance with the embodiments of the present disclosure include borate glasses, polyglycolic acid and polylactic acid. Polyglycolic acid and polylactic acid tend to degrade by hydrolysis as the temperature increases. Other suitable degradable materials include oil-degradable polymers, which may be either natural or synthetic polymers and include, but are not limited to, polyacrylics, polyamides, and polyolefins such as polyethylene, polypropylene, polyisobutylene, and polystyrene. Other suitable oil-degradable polymers include those that have a melting point that is such that it will dissolve at the temperature of the subterranean formation in which it is placed.

In addition to oil-degradable polymers, other degradable materials that may be used in conjunction with the embodiments of the present disclosure include, but are not limited to, degradable polymers, dehydrated salts, or mixtures of the two. As for degradable polymers, a polymer is considered to be "degradable" if the degradation is due to, in situ, a chemical or radical process such as hydrolysis, oxidation, or UV radiation. Suitable examples of degradable polymers that may be used in accordance with the embodiments of the present invention include polysaccharides such as dextran or cellulose; chitins; chitosans; proteins; aliphatic polyesters; poly(lactides); poly(glycolides); poly(E-caprolactones); poly(hydroxybutyrates); poly(anhydrides); aliphatic or aromatic polycarbonates; poly(orthoesters); poly(amino acids); poly(ethylene oxides); and polyphosphazenes. Of these suitable polymers, as mentioned above, polyglycolic acid and poly lactic acid may be preferred.

Polyanhydrides are another type of particularly suitable degradable polymer useful in the embodiments of the present invention. Polyanhydride hydrolysis proceeds, in situ, via free carboxylic acid chain-ends to yield carboxylic acids as final degradation products. The erosion time can be varied over a broad range of changes in the polymer backbone. Examples of suitable polyanhydrides include poly(adipic anhydride), poly(suberic anhydride), poly(sebacic anhydride), and poly(dodecanedioic anhydride). Other suitable examples include, but are not limited to, poly(maleic anhydride) and poly(benzoic anhydride).

Blends of certain degradable materials may also be suitable. One example of a suitable blend of materials is a mixture of poly lactic acid and sodium borate where the mixing of an acid and base could result in a neutral solution where this is desirable. Another example would include a blend of poly(lactic acid) and boric oxide. The choice of degradable material also can depend, at least in part, on the conditions of the well, for example, wellbore temperature. For instance, lactides have been found to be suitable for lower temperature wells, including those within the range of 60° F. to 150° F., and polylactides have been found to be suitable for well bore temperatures above this range. Also, poly(lactic acid) may be suitable for higher temperature wells. Some stereoisomers of poly(lactide) or mixtures of such stereoisomers may be suitable for even higher temperature applications. Dehydrated salts may also be suitable for higher temperature wells.

In other embodiments, the degradable material may be a galvanically corrodible metal or material configured to degrade via an electrochemical process in which the galvanically corrodible metal corrodes in the presence of an electrolyte (e.g., brine or other salt fluids in a wellbore). Suitable galvanically-corrodible metals include, but are not limited to, gold, gold-platinum alloys, silver, nickel, nickel-copper alloys, nickel-chromium alloys, copper, copper alloys (e.g., brass, bronze, etc.), chromium, tin, aluminum, iron, zinc, magnesium, and beryllium.

Figure 7A:
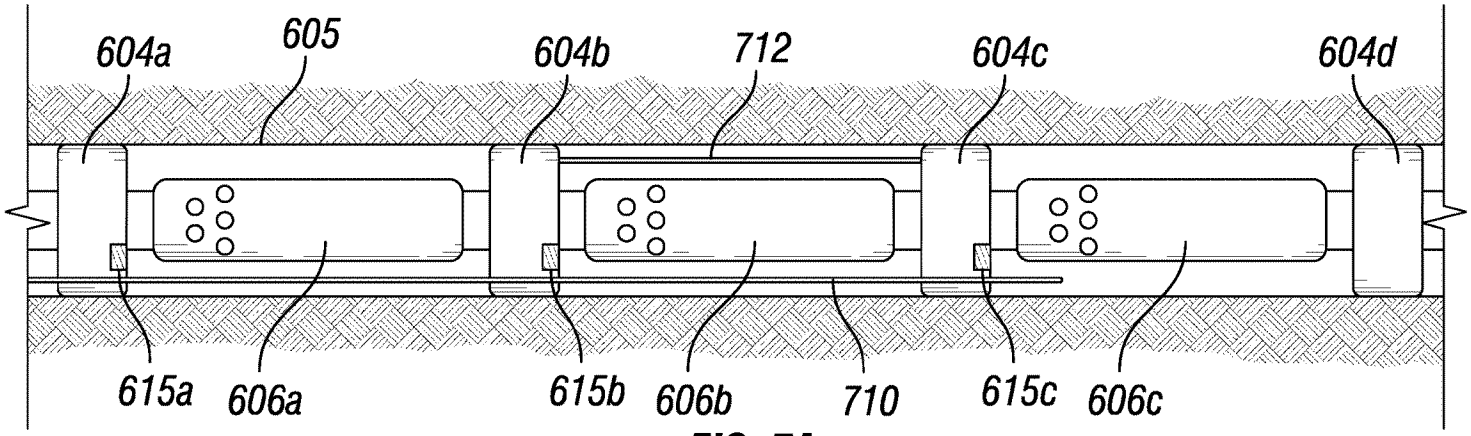
FIGS. 7A, 7B, and 7C are schematic views of a downhole sliding sleeve tool according to one or more embodiments of the present disclosure.

FIG. 7A depicts a portion of a horizontal wellbore having production tubing 605. One or more packers 604*a*, 604*b*, 604*c*, and 604*d* and one or more sliding sleeve tools 606*a*, 606*b* and 606*c* may be disposed or positioned on or about the production tubing 605. In one or more embodiments, sliding sleeve tools may comprise a sliding sleeve 132 and may be deployed downhole as illustrated in FIG. 1. The one or more packers 604*a*, 604*b*, 604*c*, and 604*d* (collectively referred to as packers 604) and one or more sliding sleeve tools 606*a*, 606*b* and 606*c* (collectively referred to as sliding sleeve tools 606). The packers 604 and sliding sleeve tools 606 may be arranged in an alternating pattern as illustrated in FIG. 7A or any other suitable configuration. Sliding sleeve tools 606 may include nodes 615*a*, 615*b* and 615*c* (collectively, nodes 615). In one or more embodiments, nodes 615*a*, 615*b* and 615*c* may be electrical or telecommunication ports.

Wireline 710 may be coupled to one or more sliding sleeve tools 606, for example sliding sleeve tools 606*a*, 606*b*, and 606*c*, via one or more nodes 615, for example nodes 615*a*, 615*b*, and 615*c*. Wireline 710 may transmit an electrical signal from one node 615 to another node 615, for example, from node 615*a* to node 615*b* or node 615*b* to node 615*c* or any combination thereof. In one or more embodiments, wireline 710 may be coupled to one or more tools at the surface (such as surface 104), for example, information handling system 804 of FIG. 8. Wireline 710 may comprise a fiber optic cable, electrical cable, network cable, communication cable, or any other type of cable used to transmit power, a signal, or both. In one or more embodiments, one or more nodes 615 may be coupled via signal path 712. Signal path 712 may be any mode of wirelessly coupling one or more nodes 615, for example an RFID signal, acoustic signal, or any other form of wireless transmission.

Figure 7B:
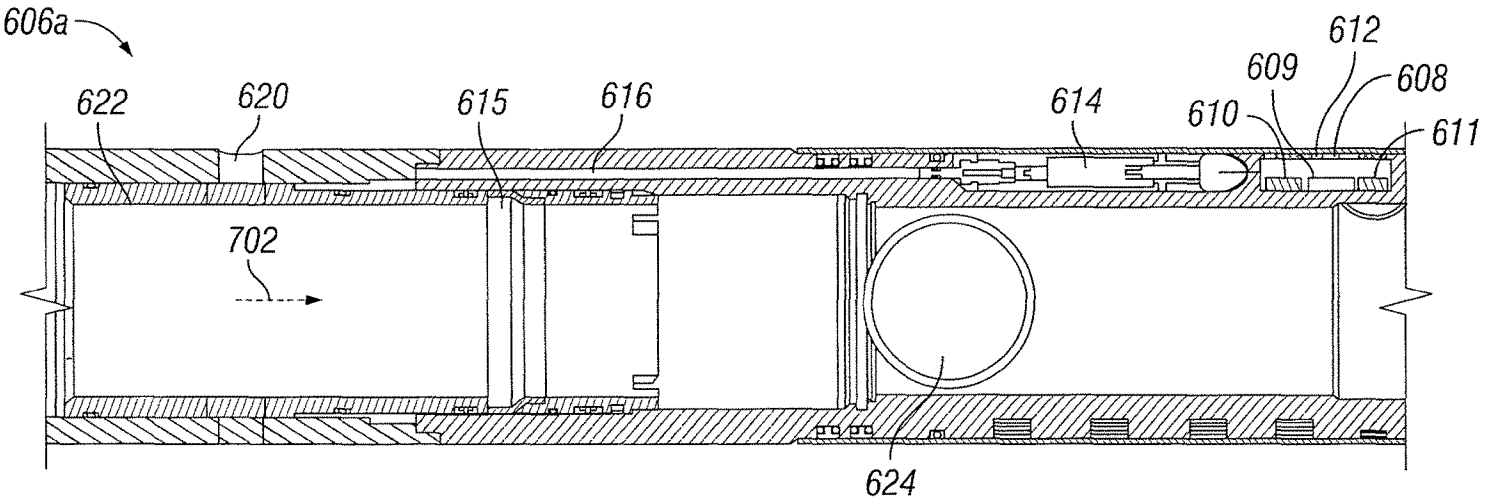
Figure 7C:
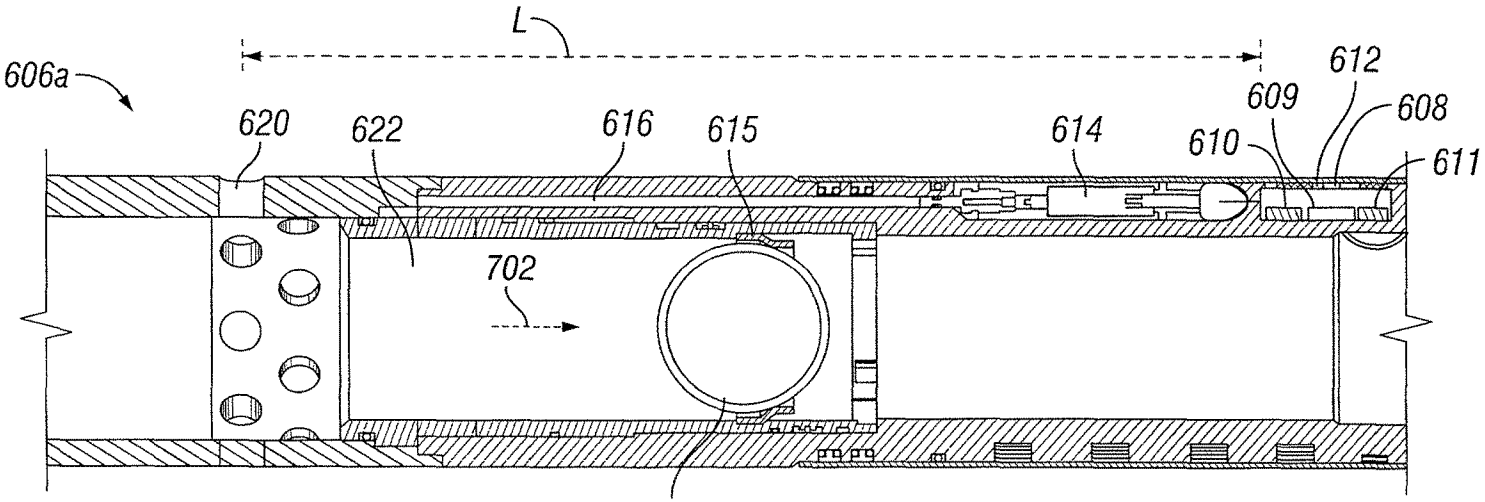

FIGS. 7B and 7C are each detailed views of sliding sleeve tool 606*a*. FIG. 7B depicts the sliding sleeve tool 606*a* in a closed configuration while FIG. 7C depicts the sliding sleeve tool 606*a* in an open configuration. Because the sliding sleeve tools 606*a*, 606*b* and 606*c* are the same, substantially the same, or function or operate in the same or similar manner, the description of the structure and operation of sliding sleeve tool 606*a*, below, applies similarly to sliding sleeve tools 606*b* and 606*c*. As depicted in FIG. 7B, sliding sleeve tool 606*a* comprises an actuator 614 and electronics device 608. The electronics device 608 may comprise an actuation sensor 609. The actuation sensor 609 may be configured to detect one or more flow rate signals. A flow rate signal may be generated by the operator, information handling system 804 of FIG. 8, or both, to control the rate of fluid flow in the wellbore. One or more sliding sleeve tools 606 may be controlled by one or more flow rate signals. For example, each sliding sleeve tool 606 may be responsive to a different flow rate signal. In one or more embodiments, a flow rate signal may be indicative of a command to a plurality of sliding sleeve tools 606. The sliding sleeve tool 606*a* may comprise a collapsible baffle 615. A chamber 616 may be disposed or positioned above or about an outer surface 618 of the sliding sleeve tool 606*a*. The chamber 616 may be coupled to the sliding sleeve tool 606*a*. In one or more embodiments, the chamber 616 may couple to a downhole sliding sleeve tool 606*a* within a wellbore 106 of FIG. 1. In one or more embodiments, the actuator 614 may be disposed or positioned within or about chamber 616. For example, the chamber 616 may house the actuator 614. The collapsible baffle 615 may collapse when fluid is introduced into a chamber 616.

The sliding sleeve tool 606*a* may include one or more of communication ports 620 disposed or positioned circumferential about the sliding sleeve tool 606*a*. The communication ports 620 allow fluid 702 to flow between the work string 114 and the formation 108 when the sliding sleeve tool 606*a* is in an open configuration as depicted in FIG. 7C. In one or more embodiments, the sliding sleeve tool 606*a* may comprise a sliding sleeve 622. Sliding sleeve 622 may transition from a closed configuration to an open configuration based, at least in part, on one or more flow rate signals.

By configuring the sliding sleeve tools 606 as illustrated in FIGS. 7A, 7B and 7C, the sliding sleeve tools 606 may be sequentially opened or closed. The sequential opening of sliding sleeve tools 606 provides for sequential completion of production zones 120*a* through 120*f* adjacent to each sliding sleeve tool 606. In one or more embodiments, a ball 624 may be dropped, injected, launched, or otherwise disposed or positioned into the wellbore to transition the sliding sleeve 622 from a closed configuration to an open configuration. In one or more embodiments, one or more flow rate signals may transition the sliding sleeve 622 from a closed position to an open position. When the baffles 615 are in an open configuration, a ball 624 may pass through the sliding sleeve tool 606*a* and then towards a distal end of the wellbore. When the baffle 615 is collapsed, a ball 624 may be caught, trapped, or otherwise captured by the baffle 615. The ball 624 may form a seal against the baffle 615.

As fluid 702 is pumped into the wellbore 106 and through sliding sleeve 622, the ball 624 prevents the fluid 702 from flowing distally or form one end to the other through the sliding sleeve tool 606*a* causing hydraulic pressure to build behind the ball 624. The hydraulic pressure exerts a force on the ball 624 and baffle 615. Once the pressure reaches a threshold, the sliding sleeve 622 is forced to an open configuration exposing the ports 620 to the wellbore.

In one or more embodiments, baffles 615 within one or more sliding sleeve tools 606 may be deployed based, at least in part, on one or more flow rate signals. Deployment of one or more baffles 615 may comprise transitioning or otherwise causing a ball 624 to land or otherwise be positioned or disposed on one of the one or more baffles 615. In one or more embodiments, one or more sliding sleeve tools 606 may open, close, or both based, at least in part, on one or more flow rate signals. In one or more embodiments, the sliding sleeve tools 606 are transitioned by the one or more flow rate signals or the ball 624. In one or more embodiments, any one or more of a sliding sleeve tool 606 may transition open and a lower sliding sleeve tool 606 may transition to close based, at least in part, on one or more flow rate signals. In one or more embodiments, any one or more of a sliding sleeve tool 606 may open and a flapper valve may close based, at least in part, on the one or more flow rate signals. In one or more embodiments, one or more baffles 615 and one or more sliding sleeve tools 606 may be deployed based, at least in part, on one or more flow rate signals.

In one or more embodiments, a completion operation may require only one flow rate signal per sliding sleeve tool 606. In one or more embodiments, sliding sleeve tools 606 may be required to perform additional functions and additional flow rate signals may be required.

In one or more embodiments, the electronics device 608 may further comprise a property sensor 610. In one or more embodiments, property sensor 610 may be battery powered and may not require any wired connection. The property sensor 610 may comprise any one or more of a magnetic sensor, temperature sensor, fluid flow sensor, pressure sensor, any other type of sensor capable of measuring one or more characteristics of a zone associated with the sliding sleeve 622, production tubing 605, actuator 614, wellbore 106, or any combination thereof. The electronics device 608 may comprise a housing 612 that insulates the property sensor 610 from a fluid, a gas, a particle, any other fluid or material, or any combination thereof. Property sensor 610 may measure or sense any one or more of a flow property, temperature property, or any other property or characteristic associated with the wellbore 106, production tubing 610, actuator 614, a section of any of the above associated with the property sensor 610, or any combination thereof. For example, in one or more embodiments, property sensor 610 may comprise a thermometer that monitors the temperature of a fluid 702 that flows into a formation 108 of a particular zone 128 of the wellbore 106. In one or more embodiments, the thermometer can be a device for measuring the temperature or temperature change in the wellbore 106. In one or more embodiments, the thermometer may be a thermocouple, an optical thermometer, a digital thermostat, integrated-circuit temperature devices, thermistor, a resistance thermometer, a thermoelectric sensor, or any other device capable of measuring temperature.

In one or more embodiments, the flow rate of a fluid 702 may be determined by measuring a cool-down effect. During an injection process, one or more stimulation fluids, for example, fluid 702, may reduce the temperature around the thermometer in a wellbore. As would be appreciated by one of ordinary skill in the art, by measuring the amount of temperature cool-down and the duration of the temperature cool-down, the amount of fluid stimulation fluid that was injected into a wellbore 106 or a particular zone 128 of a wellbore 106 may be estimated. Comparing the amount of temperature cool-down, duration of temperature cool-down, or both, between thermometers at one or more zones 128, may allow a determination of the relative acceptance of one or more fluids 702 into the one or more zones 128. The relative acceptance of one or more fluids 702 may be a function of the operational stages of the stimulation. For example, during early production, a zone that has accepted more stimulation fluid may show a reduced temperature (because the stimulation fluid has cooled the formation) compared to a zone that has accepted less stimulation fluid. In later production, the production of fluids may result in a local temperature change due to the Joule-Thomson effect. The magnitude and sign (direction) of the Joule-Thomson effect may vary for different fluids and may be used as a relative estimate for the composition of a produced fluid. In one or more embodiments, an operator may use the absolute temperature indicated by the thermometer or the relative temperature change between flowing and non-flowing conditions to estimate one or more parameters associated with a fluid 702. The estimated parameter may be a flow rate, total injected fluid volume, or any other parameter associated with fluid flow.

In one or more embodiments, the electronics device 608 may further comprise a transceiver 611. The transceiver 611 may be coupled, either directly or indirectly, to the property sensor 610. The transceiver 611 may receive one or more measurements from property sensor 610. The transceiver 611 may send a signal based on the one or more measurements received from sensor 610 to the surface or to another transceiver, for example, a transceiver 611 associated with sliding sleeve tool 606. The transceiver 611 may send the signal via an acoustic wave or via an electromagnetic wave. In one or more embodiments, the transceiver 611 may be a piezoelectric transducer that creates an acoustic wave that propagates through the tubing, formation, wellbore fluids, or any combination thereof. In one or more embodiments, the transceiver 611 sends a signal from one sleeve section to a second sleeve section, for example, from sleeve tool **606*a* to sleeve tool 606*b*. In one or more embodiments, the transceiver 611 sends a signal from a sleeve section, for example, sleeve tool 606*a*, to a wireline tool that is conveyed down the interior of the tubing string. The signal may be received by an information handling system, for example information handling system 804 of FIG. 8. Information handling system 804 may calculate or determine a flow rate of a fluid 702 associated with the sliding sleeve tool 606*a* based, at least in part, on one or more signals received from transceiver 611, where the one or more signals are associated with one or more measurements received from a sensor 610. In one or more embodiments, the electronics device 608, property sensor 610, transceiver 611**, or any combination thereof, may be battery powered.

Figure 8:
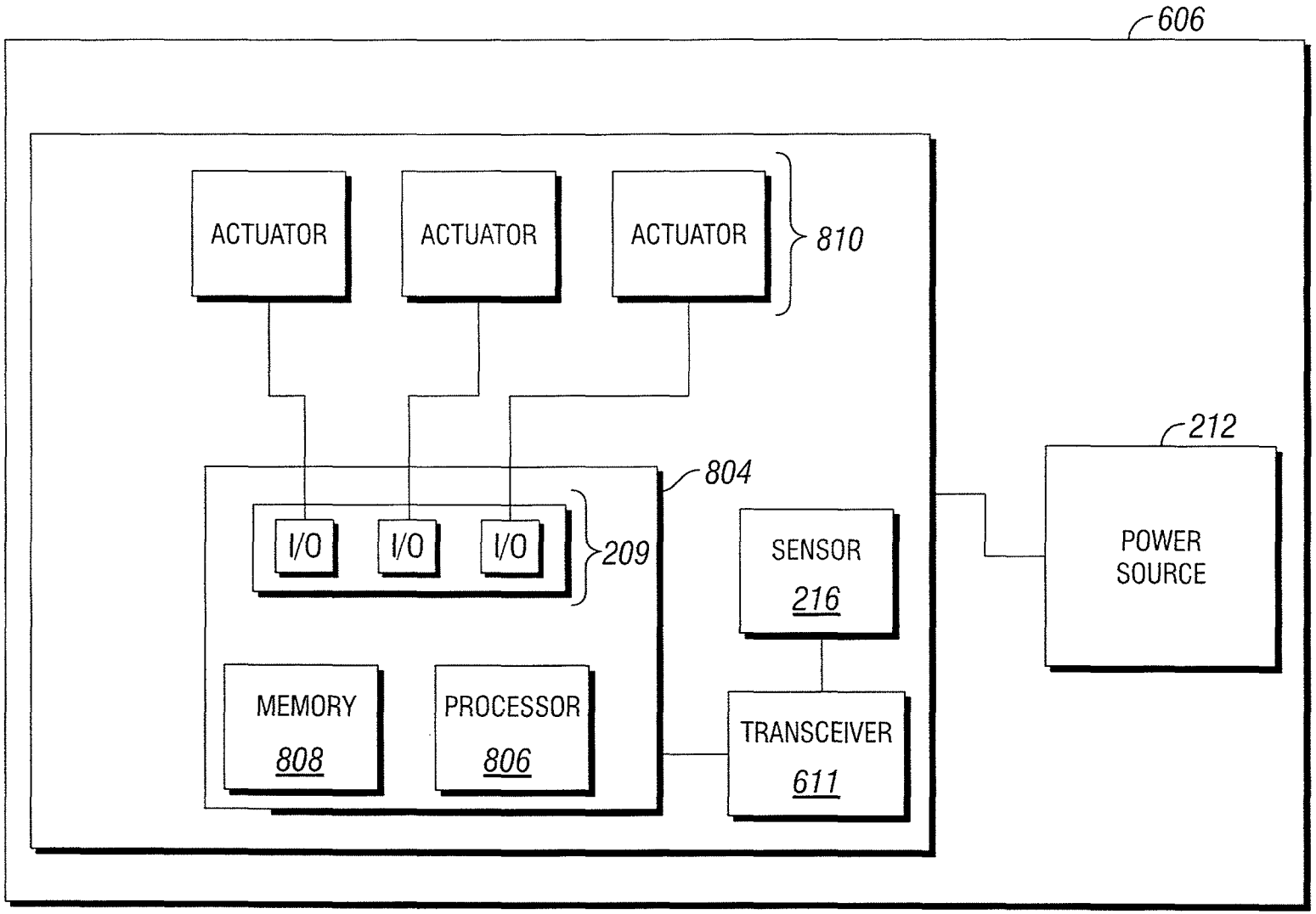
FIG. 8 is a block diagram depicting an information handling system and other electronic components of a sliding sleeve tool, according to one or more embodiments of the present disclosure.

FIG. 8 is a block diagram depicting an information handling system 804 and other electronic components of a sliding sleeve tool 606, according to one or more embodiments of the present disclosure. In one or more embodiments, the information handling system 804 communicates with one or more actuators 810 to operate the sliding sleeve tool **606*a*. The information handling system 804 may transmit a signal to one or more sliding sleeve tools 606 to change a configuration, position, mode, or any combination thereof of the one or more sleeve tools 606. In one or more embodiments, one or more actuators 810** may comprise any suitable actuator, including, an electromagnetic device, such as a motor, gearbox, linear screw, a solenoid actuator, a piezoelectric actuator, a hydraulic pump, a chemically activated actuator, a heat activated actuator, a pressure activated actuator, or any combination thereof.

Information handling system 804 may be coupled, either directly or indirectly, to one or more transceivers 611. In one or more embodiments, information handling system 804 may be coupled to only one transceiver, for example transceiver 611 associated with a sliding sleeve tool 606. In one or more embodiments, information handling system 804 may be coupled to one or more transceivers 611 associated with one or more sliding sleeve tools 606. Information handling system 804 may be coupled to one or more transceivers 611 either by an electrical wire, for example wireline 710, or wirelessly, for example through signal path 712. Information handling system 804 may comprise a memory 808 for storing information one from one or more transceivers 611, for example, one or more measurements received by a transceiver 611 from property sensor 610. Information handling system 804 may further comprise a processor 806 for processing the information. For example, information handing system 804 may comprise a processor for calculating a flow rate of fluid 702 associated with one or more sliding sleeve tools 606.

Information handling system 804 may determine or calculate one or more properties or characteristics of a fracture 144 at or near a property sensor 610 based, at least in part, on information received by an associated transceiver 611. For example, a property or characteristic determined or calculated by information handling system 804 may be associated with an area or zone at a threshold distance from the property sensor 610, for example, up to 30 feet from the property sensor 610. In one or more embodiments, the property sensor 610 measures one or more properties of the fluid as they flow past the property sensor 610. In one or more embodiments, information handling system 804 may determine or calculate a flow rate of a fluid 702, a pump-out time, production estimate, or any combination thereof based, at least in part, on information from the transceiver 611. Information handling system 804 may alter or adjust an operation of a sliding sleeve tool 606. For example, based, at least in part, on a determined or calculated property or characteristic, information handling system 804 may transmit a signal to actuate a sliding sleeve tool 606. In one or more embodiments, information handling system 804 may transmit a signal to one or more actuators 614 to power off or cease actuation of a sliding sleeve tool 606.

In one or more embodiments, a production operation may be altered or adjusted based, at least in part, on one or more flow rate properties of one or more production zones 120 determined or calculated by the information handling system 804. For example, the optimal zone for production may be determined by comparing the flow rate properties of each production zone 120. Single-point entry techniques or multi-point entry techniques may then be used based, at least in part, on the comparison of the flow rate properties of one or more production zones 120. A production operation may be adjusted or altered manually by an operator or automatically by the information handling system 804, or both. For example, in one or more embodiments, one or more flow rate properties determined or calculated by the information handling system 804 may be output to an operator. In one or more embodiments, a control signal may be transmitted or communicated from the information handling system 804 to the sliding sleeve tool 606 to alter, increase, decrease, cease, or otherwise change the amount or rate of fluid 702, for example, a stimulation fluid, injected into the production tubing 605 or wellbore 106. For example, an operator may input a command, based, at least in part, on any one or more determined or calculated flow rate properties that causes the information handling system 804 to send the control signal. In one or more embodiments, the information handling system 804 may automatically send a control signal to alter, increase, decrease, cease, or otherwise change the amount or rate of fluid 702 injected into the production tubing 605 or wellbore 106.

Figure 9:
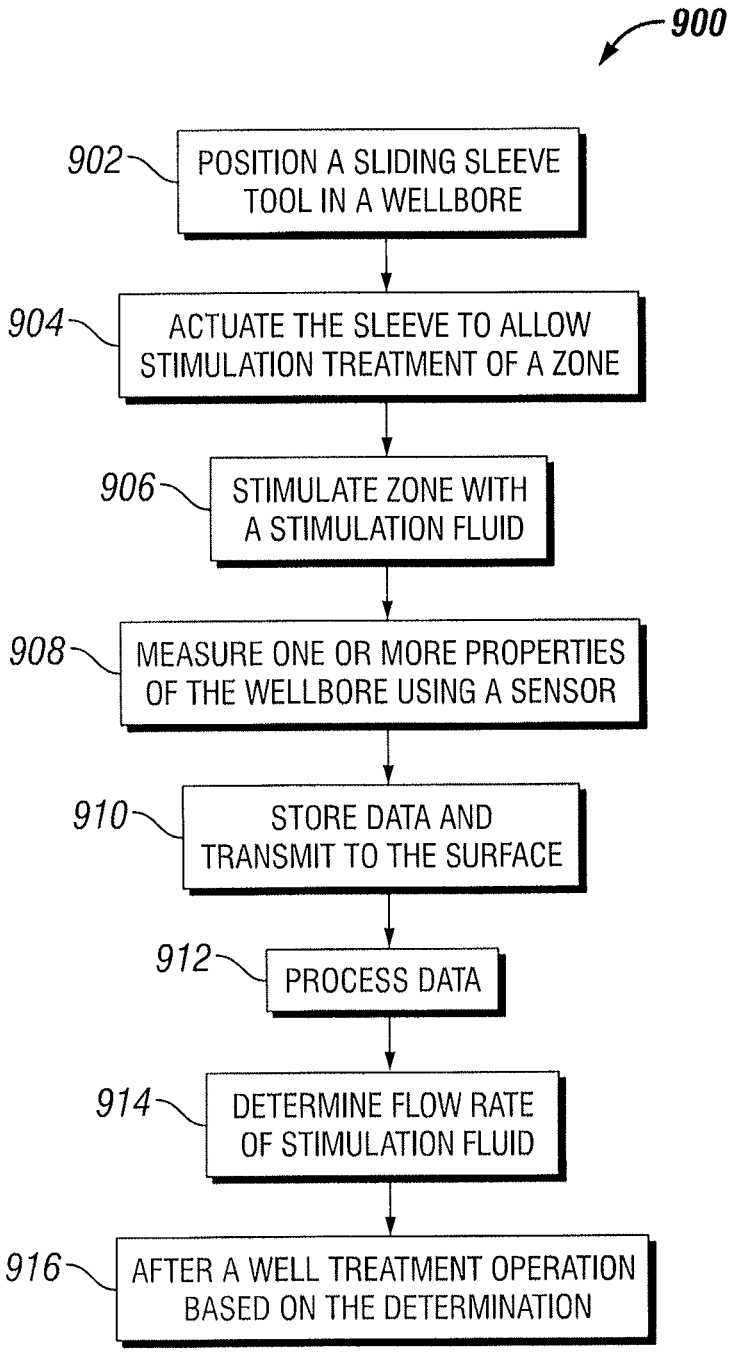
FIG. 9 is a flow diagram for altering a well treatment operation based, at least in part, on a calculated flow rate of stimulation fluid, according to one or more embodiments of the present disclosure.

FIG. 9 is a flowchart of a method 900 according to one or more embodiments of the present disclosure. The steps of method 900 may be performed by various computer programs or non-transitory computer readable media that may comprise one or more instructions operable to perform or capable of performing, when executed by a processor, one or more steps described below. The computer programs and computer readable media may be configured to direct a processor or other suitable unit to retrieve and execute the instructions from the computer readable media.

At step 902, one or more sliding sleeve tools, for example sliding sleeve tool 606*a*, may be positioned or disposed within a wellbore 106. The sliding sleeve tool 606*a* may be positioned or disposed by a wireline or cable, for example, wireline 140 of FIG. 1, as understood by one of ordinary skill in the art. For example, sliding sleeve tool 606*a* may be used in wellbore stimulation operations such as multi-entry sliding sleeves, single entry sliding sleeves, and toe sleeves.

At step 904, the sliding sleeve 622 may be actuated within the wellbore 106. In one or more embodiments, the sliding sleeve 622 may be actuated in response to one or more flow rate signals via the baffle 615 as discussed with respect to FIGS. 7A, 7B, and 7C. One or more flow rate signals may cause a baffle 615 to deploy. The deployment of one or more baffles 615 may cause a ball 624 to land against a baffle 615. As fluid, for example, fluid 702, is pumped into the wellbore 106, the ball 624 prevents the fluid 702 from flowing through the sliding sleeve tool 606*a* causing hydraulic pressure to build behind the ball 624. The hydraulic pressure exerts a force on the ball 624 and baffle 615. Once the pressure reaches a threshold, the sliding sleeve 622 is forced to an open configuration exposing ports 620 to the wellbore 106. In one or more embodiments, the sliding sleeve 622 may be actuated in response to one or more wellbore darts 502*a* as discussed with respect to FIGS. 5A, 5B, and 5C. The sliding sleeve 622 may be actuated based at least in part, on detection of a predetermined number of wellbore darts, for example wellbore dart 200 of FIG. 2A or wellbore dart 502*a* of FIG. 5A.

At step 906, a production zone 120 associated with a fracture 144 of the wellbore 106 may be stimulated. In one or more embodiments, a stimulation fluid, for example, fluid 702, may be injected into the wellbore 106 automatically upon actuation of the sliding sleeve 622 in step 904. In one or more embodiments, an operator may manually initiate the stimulation process upon actuation of the sliding sleeve 622. Stimulation of a production zone 120 may occur via any one or more methods as understood by one of ordinary skill in the art.

At step 908, one or more properties of a production zone 120 may be measured via a property sensor 610. As discussed with FIGS. 7B and 7C, the property sensor 610 may be a magnetic sensor, temperature sensor, fluid flow sensor, pressure sensor, or any other type of sensor capable of measure a property or characteristic of a particular production zone 120 of the wellbore 106. The property sensor 610 may determine a flow rate, temperature, or any other feature, characteristic, or property of the production zone 120.

At step 910, a property or characteristic measured by property sensor 610 may be stored and transmitted to the surface 104, for example, to information handling system 804 of FIG. 8. Downhole information, for example, one or more measurements associated with a property sensor 610, may be transmitted via transceiver 611 to surface 104 as shown in FIGS. 7B and 7C. Transceiver 611 may be coupled to property sensor 610, directly or indirectly. In one or more embodiments electronics device 608 may comprise memory to store the information downhole. Memory downhole or at the surface may be comprised of RAM, ROM, solid state memory, disk-based memory, or any other memory as understood by one of ordinary skill in the art.

At step 912, information received at the surface by information handling system 804 may be processed by a processor. The processor may be communicatively coupled to a memory. The processor may include, for example, a microprocessor, microcontroller, digital signal processor, application specific integrated circuit, or any other digital or analog circuitry configured to process the information. The information handling system 804 may process the information to determine or calculate an output, for example the flow rate of stimulation fluid as shown in step 914. A property or characteristic of a fracture 144 or production zone 120 may be calculated or determined based, at least in part, on a flow rate of stimulation fluid, for example fluid 702. For example, the flow rate of stimulation fluid may be correlated with the size of a fracture 144 or any other property or characteristic of the fracture 144.

At step 916, a well treatment or production operation may be altered based, at least in part, on the calculated or determined flow rate of the stimulation fluid in step 914. As described above with respect to FIG. 8, the well treatment or production operation may be altered manually by an operator or automatically by the information handling system 804. For example, the operator or information handling system 804 may transmit a control signal to alter, increase, decrease, cease, or otherwise change the pressure or rate of stimulation fluid injected into the production tubing 605 or wellbore 106.

Embodiments disclosed herein include:

A. A sliding sleeve assembly that includes a completion body that defines an inner flow passageway and one or more ports that enable fluid communication between the inner flow passageway and an exterior of the completion body, a sliding sleeve arranged within the completion body and having a sleeve mating profile defined on an inner surface of the sliding sleeve, the sliding sleeve being movable between a closed position, where the sliding sleeve occludes the one or more ports, and an open position, where the sliding sleeve is moved to expose the one or more ports, a plurality of wellbore darts each having a body and a dart profile defined on an outer surface of the body, the dart profile of each wellbore dart being matable with the sleeve mating profile, one or more sensors positioned on the completion body to detect the plurality of well bore darts as traversing the inner flow passageway, and an actuation sleeve arranged within the completion body and movable between a run-in configuration, where the actuation sleeve occludes the sleeve mating profile, and an actuated configuration, where the actuation sleeve is moved to expose the sleeve mating profile.

B. A method that includes introducing one or more wellbore darts into a work string extended within a wellbore, the work string providing a sliding sleeve assembly that includes a completion body defining an inner flow passageway and one or more ports that enable fluid communication between the inner flow passageway and an exterior of the completion body, wherein the sliding sleeve assembly further includes a sliding sleeve arranged within the completion body and defining a sleeve mating profile on an inner surface of the sliding sleeve, detecting the one or more wellbore darts with one or more sensors positioned on the completion body, the one or more wellbore darts each having a body and a dart profile defined on an outer surface of the body, moving an actuation sleeve arranged within the completion body from a run-in configuration to an actuated configuration when the one or more sensors detects a predetermined number of the one or more wellbore darts, exposing the sleeve mating profile as the actuation sleeve moves to the actuated configuration, locating one of the one or more wellbore darts on the sliding sleeve as the dart profile of the one of the one or more wellbore darts mates with the sleeve mating profile, increasing a fluid pressure within the work string uphole from the one of the one or more wellbore darts, and moving the sliding sleeve from a closed position, where the sliding sleeve occludes the one or more ports, to an open position, where the one or more ports are exposed.

Each of embodiments A and B may have one or more of the following additional elements in any combination: Element 1: further comprising electronic circuitry communicably coupled to the one or more sensors, and an actuator communicably coupled to the electronic circuitry, wherein, when the one or more sensors detect a predetermined number of the plurality of wellbore darts, the electronic circuitry sends an actuation signal to the actuator to move the actuation sleeve to the actuated configuration. Element 2: wherein the actuator is selected from the group consisting of a mechanical actuator, an electro-mechanical actuator, a hydraulic actuator, a pneumatic actuator, and any combination thereof. Element 3: wherein the actuator is an electro-hydraulic piston lock. Element 4: wherein each wellbore dart exhibits a known magnetic property detectable by the one or more sensors. Element 5: wherein each wellbore dart emits a radio frequency detectable by the one or more sensors. Element 6: wherein the one or more sensors are mechanical switches that are mechanically manipulated through physical contact with the plurality of wellbore darts as each wellbore dart traverses the inner flow passageway. Element 7: wherein at least a portion of the body of each well bore dart is made from a material selected from the group consisting of iron, an iron alloy, steel, a steel alloy, aluminum, an aluminum alloy, copper, a copper alloy, plastic, a composite material, a degradable material, and any combination thereof. Element 8: wherein the degradable material is a material selected from the group consisting of a borate glass, a galvanically-corrodible metal, polyglycolic acid, poly lactic acid, and any combination thereof. Element 9: wherein the actuation sleeve includes an axial extension that extends within at least a portion of the sliding sleeve to occlude the sleeve mating profile.

Element 10: wherein the sliding sleeve assembly further includes electronic circuitry communicably coupled to the one or more sensors, and wherein detecting the one or more wellbore darts with the one or more sensors comprises sending a detection signal to the electronic circuitry with the one or more sensors upon detecting each wellbore dart, and counting with the electronic circuitry how many wellbore darts have been detected by the one or more sensors based on each detection signal received. Element 11: wherein the sliding sleeve assembly further includes an actuator communicably coupled to the electronic circuitry, and wherein moving the actuation sleeve further comprises sending an actuation signal to the actuator with the electronic circuitry when the one or more sensors detects the predetermined number of the one or more wellbore darts, and actuating the actuation sleeve with the actuator to the actuated configuration upon receiving the actuation signal. Element 12: wherein detecting the one or more wellbore darts with the one or more sensors comprises detecting a known magnetic property exhibited by the one or more wellbore darts. Element 13: wherein detecting the one or more wellbore darts with the one or more sensors comprises detecting a radio frequency emitted by the one or more wellbore darts. Element 14: wherein the one or more sensors are mechanical switches, and wherein detecting the one or more wellbore darts with the one or more sensors comprises physically contacting the one or more sensors with the one or more wellbore darts as the one or more wellbore darts traverse the inner flow passageway. Element 15: wherein increasing the fluid pressure within the work string uphole from the subsequent one of the one or more wellbore darts further comprises generating a pressure differential across the one of the one or more wellbore darts and thereby transferring an axial load to the sliding sleeve and one or more shearable devices securing the sliding sleeve in the closed position, and assuming a predetermined axial load with the one or more shearable devices such that the one or more shearable devices fail and thereby allow the sliding sleeve to move to the open position. Element 16: further comprising introducing a treatment fluid into the work string, injecting the treatment fluid into a surrounding subterranean formation via the one or more ports, and releasing the fluid pressure within the work string. Element 17: wherein at least a portion of the one or more well bore darts is made of a degradable material selected from the group consisting of a borate glass, a galyanically corrodible metal, polyglycolic acid, polylactic acid, and any combination thereof, the method further comprising allowing the degradable material to degrade. Element 18: further comprising introducing a drill bit into the work string and advancing the drill bit to the one of the one or more wellbore darts, and drilling out the one of the one or more well bore darts with the drill bit.

By way of example, Embodiment A may be used with Elements 1, 2, and 3; with Elements 1, 7, and 8; with Elements 1, 7, 8, and 10; with Elements 1, 4, and 5, etc.

By way of further example, Embodiment B may be used with Elements 12 and 13; with Elements 12, 13, and 14; with Elements 15 and 16; with Elements 16, 17, and 18, etc.

C. A method for determining a property of a production zone, comprising: positioning a sliding sleeve tool within a wellbore, actuating the sliding sleeve tool, wherein the actuating is initiated based, at least in part, on one or more measurements received by an actuation sensor, stimulating a production zone with a stimulation fluid, detecting one or more properties of the wellbore based, at least in part, on one or more measurements received by a property sensor, determining a parameter of the stimulation fluid from at least one of the one or more properties.

D. A system for determining a property of a production zone, comprising: a sliding sleeve tool, wherein the sliding sleeve tool is disposed on a production tubing, and wherein the sliding sleeve tool further comprises: an actuation sensor, a property sensor; and a transceiver coupled to the property sensor; an information handling system communicatively coupled to the transceiver, the information handling system comprising a processor and a non-transitory memory coupled to the processor, wherein the non-transitory memory comprises one or more instructions that when executed by the processor, cause the processor to position the sliding sleeve tool within a wellbore; actuate the sliding sleeve tool based, at least in part, on one or more measurements received by the actuation sensor, stimulate a production zone with a stimulation fluid, detect one or more properties of the wellbore based, at least in part, on one or more measurements received by the property sensor, and determine a parameter of the stimulation fluid.

E. A non-transitory storage computer readable medium storing one or more instructions that when executed by the processor, cause the processor to position a sliding sleeve tool within a wellbore, actuate the sliding sleeve tool based, at least in part, on one or more measurements received by an actuation sensor, stimulate a production zone with a stimulation fluid, detect one or more properties of the wellbore based, at least in part, on one or more measurements received by a property sensor, and determine a flow rate of the stimulation fluid.

Each of embodiments C, D, and E may have one or more of the following elements in any combination: Element 1: wherein the property sensor is disposed adjacent to the sliding sleeve tool. Element 2: wherein the property sensor is a battery-powered sensor. Element 3: wherein the one or more measurements received by the property sensor is a temperature measurement. Element 4: wherein the parameter of the stimulation fluid is a flow rate or a total volume of the stimulation fluid. Element 5: further comprising altering a well treatment operation based, at least in part, on the flow rate of the simulation fluid. Element 6: further comprising storing the one or more measurements received by the property in a memory. Element 7: further comprising transmitting the one or more measurements received by the property sensor wirelessly to the surface, to a downhole tool within the wellbore, or both. Element 8: further comprising determining a relative acceptance of the stimulation fluid based, at least in part, on the parameter of the stimulation fluid. Element 9: wherein the information handling system is communicatively coupled to the transceiver wirelessly. Element 10: wherein the one or more instructions, that when executed by the processor, further cause the processor to store the one or more measurements received by the property sensor to a memory.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces.

What is claimed is:

1. A method for determining a property of a production zone, comprising:

positioning a sliding sleeve tool within a wellbore, wherein the sliding sleeve tool comprises an electronics housing;

actuating the sliding sleeve tool, wherein the actuating is initiated based, at least in part, on one or more measurements received by an actuation sensor, wherein the actuation sensor is disposed within the electronics housing;

stimulating one or more production zones with a stimulation fluid;

detecting one or more properties of the wellbore based, at least in part, on one or more measurements received by a property sensor, wherein the property sensor is disposed within the electronics housing;

determining a parameter of the stimulation fluid from at least one of the one or more properties; and determining a relative acceptance of the stimulation fluid for the one or more production zones based, at least in part, on the parameter of the stimulation fluid.

2. The method of claim 1, wherein the property sensor is disposed adjacent to the sliding sleeve tool.

3. The method of claim 1, wherein the property sensor is a battery-powered sensor.

4. The method of claim 1, wherein the one or more measurements received by the property sensor is a temperature measurement.

5. The method of claim 1, wherein the parameter of the stimulation fluid is a flow rate or a total volume of the stimulation fluid.

6. The method of claim 5, further comprising:

altering a well treatment operation based, at least in part, on the flow rate of the stimulation fluid.

7. The method of claim 1, further comprising:

storing the one or more measurements received by the property in a memory.

8. The method of claim 1, further comprising:

transmitting the one or more measurements received by the property sensor wirelessly to the surface, to a downhole tool within the wellbore, or both.

9. A system for determining a property of a production zone, comprising:

a sliding sleeve tool, wherein the sliding sleeve tool is disposed on a production tubing, and wherein the sliding sleeve tool further comprises:

an electronics housing;

an actuation sensor disposed within the electronics housing;

a property sensor disposed within the electronics housing; and a transceiver coupled to the property sensor;

an information handling system communicatively coupled to the transceiver, the information handling system comprising:

a processor; and a non-transitory memory coupled to the processor, wherein the non-transitory memory comprises one or more instructions that when executed by the processor, cause the processor to:

position the sliding sleeve tool within a wellbore;

actuate the sliding sleeve tool based, at least in part, on one or more measurements received by the actuation sensor;

stimulate one or more production zones with a stimulation fluid;

detect one or more properties of the wellbore based, at least in part, on one or more measurements received by the property sensor;

determine a parameter of the stimulation fluid from at least one of the one or more properties; and determine a relative acceptance of the stimulation fluid for the one or more production zones based, at least in part, on the parameter of the stimulation fluid.

10. The system of claim 9, wherein the property sensor is disposed adjacent to the sliding sleeve tool.

11. The system of claim 9, wherein the property sensor is battery powered.

12. The system of claim 9, wherein the parameter of the stimulation fluid is a flow rate or a total volume of the stimulation fluid.

13. The system of claim 12, wherein the one or more instructions that, when executed by the processor, further cause the processor to alter a well treatment operation based, at least in part, on the flow rate of the stimulation fluid.

14. The system of claim 9, wherein the information handling system is communicatively coupled to the transceiver wirelessly.

15. A non-transitory storage computer readable medium storing one or more instructions that when executed by a processor, cause the processor to:

position a sliding sleeve tool within a wellbore, wherein the sliding sleeve tool comprises an electronics housing;

actuate the sliding sleeve tool based, at least in part, on one or more measurements received by an actuation sensor, wherein the actuation sensor is disposed within the electronics housing;

stimulate one or more production zones with a stimulation fluid;

detect one or more properties of the wellbore based, at least in part, on one or more measurements received by a property sensor, wherein the property sensor is disposed within the electronics housing;

determine a flow rate of the stimulation fluid from at least one of the one or more measurements; and determine a relative acceptance of the stimulation fluid for the one or more production zones based, at least in part, on the flow rate of the stimulation fluid.

16. The non-transitory storage computer readable medium of claim 15, wherein the one or more instructions, that when executed by the processor, further cause the processor to alter a well treatment operation based, at least in part, on the flow rate of the stimulation fluid.

17. The non-transitory storage computer readable medium of claim 15, wherein the one or more instructions, that when executed by the processor, further cause the processor to wirelessly transmit the one or more measurements received by the property sensor.

18. The non-transitory storage computer readable medium of claim 15, wherein the one or more instructions, that when executed by the processor, further cause the processor to store the one or more measurements received by the property sensor to a memory.

* * * * *